United States Patent [19]

Katayama et al.

[11] 4,139,300

[45] Feb. 13, 1979

[54] COPYING APPARATUS WITH VARIABLE STOP POSITION

[75] Inventors: Hajime Katayama; Hiroshi Nitanda; Tateki Nagaoka, all of Tokyo; Hirotoshi Kishi, Higashimurayama; Yusaku Takada, Tokyo; Noriyoshi Iida, Ichikawa; Tsuneki Inuzuka, Fuchu; Yutaka Komiya, Tokyo, all of Japan

[73] Assignee: Canon Kabushiki Kaisha, Tokyo, Japan

[21] Appl. No.: 624,118

[22] Filed: Oct. 20, 1975

[30] Foreign Application Priority Data

Dec. 13, 1974 [JP] Japan ..... 49-143891
Oct. 22, 1974 [JP] Japan ..... 49-127795[U]

[51] Int. Cl.[2] ..... G03G 21/00

[52] U.S. Cl. ..... 355/14; 355/8; 355/15

[58] Field of Search ..... 355/14, 3 DR, 8, 10, 355/15

[56] References Cited

U.S. PATENT DOCUMENTS

| | | | |
|---|---|---|---|
| 3,560,087 | 2/1971 | Washio et al. | 355/14 |
| 3,692,401 | 9/1972 | Kawai | 355/14 |
| 3,697,169 | 10/1972 | Maksymiak et al. | 355/14 |
| 3,819,261 | 6/1974 | Ogawa | 355/14 |
| 3,834,805 | 9/1974 | Griffin, Jr. | 355/14 |
| 3,865,482 | 2/1975 | Bendall et al. | 355/14 |
| 3,878,540 | 4/1975 | Kawai | 355/14 |
| 3,917,396 | 11/1975 | Donohue et al. | 355/14 |
| 3,948,586 | 4/1976 | Komori et al. | 355/14 |
| 3,980,404 | 9/1976 | Townsend | 355/10 |

*Primary Examiner*—A. D. Pellinen
*Attorney, Agent, or Firm*—Fitzpatrick, Cella, Harper & Scinto

[57] ABSTRACT

In a copying apparatus having an endless photosensitive medium, a number of copy process devices for forming an electrostatic latent image on the photosensitive medium, for developing the latent image, for transferring the developed image and for cleaning the photosensitive medium, there is provided circuitry for controlling the operation of at least one of the copy process devices in accordance with the generation of a predetermined number of clock signals. The control circuitry acts to start the initiation of the copy process after counting a predetermined number of signals and to stop the rotation of the medium at a different rotational position from the start position. The apparatus also includes a jam detecting device and reciprocating member for the formation of the latent image, the position of which is detected for utilization in the control circuitry.

40 Claims, 30 Drawing Figures

(a)

(b)

(a)

283
CEXC
276
CPFOR
301
303
D
S̄
Q
306
LRT
241
IOCP
CP
R̄
Q̄
LRT
224
271
CCMD
302
304
208
STOP
305
(b)
208'
271'
276'
283'
241'
306'

(a)

311
CBHP
314
271
CCMD
315
324
D
S̄
Q
276
CBFOR
222
CLCK
316
317
CP
R̄
Q̄
325
CBREV
326
283
CEXC
318
288
4CP
319
259
B5C
320
312
B5BP
322
323
223
CBBP
258
A4C
287
A4BP
321
313
B4BP
208
STOP
327

COPYING APPARATUS WITH VARIABLE STOP POSITION

BACKGROUND OF THE INVENTION

1. Field of the Invention

This invention relates to an electrophotographic copying apparatus of the slit exposure type using a movable original carriage or optical system, and more particularly to an electrophotographic copying apparatus provided with a novel control system.

2. Description of the Prior Art

Copying apparatus have heretofore employed a photosensitive medium in the form of a drum or a belt or the like which may be reused. However, the photosensitive medium presents different sensitivity characteristics depending on its history of irradiation with light, and accordingly the sensitivity of the photosensitive medium differs from a first copy to a second one.

Further, if the photosensitive medium is left unused after a copying operation, as will later be described, toner particles may sometimes fix to the area of contact between the photosensitive medium and a cleaning blade. In addition, the photosensitive medium, which is subjected to high voltage charges of varying potential, presents different surface potentials and polarities in various parts thereof and if the photosensitive medium is left in such condition, the characteristic of the drum will be adversely affected.

To overcome these problems, the photosensitive medium has been pre-treated, that is, the drum has been made to effect introductory rotation for uniform exposure prior to formation of an electrostatic latent on the photosensitive medium, whereby the sensitivity characteristic of the photosensitive medium has been made uniform for the first and subsequent copies with the fatigue effect of the photosensitive medium in view, and also the toner particles fixed to the photosensitive medium have been removed by cleaning the drum.

As a further countermeasure, the photosensitive medium has been subjected to post-treatment, that is, after substantial completion of the copying operation, the drum has been made to effect one more rotation so that accumulated charges on the photosensitive medium may be removed as by AC corona discharge.

However, the position at which the photosensitive medium stops after completion of the entire copy cycle has always been fixed and therefore, the effect of the corona charge concentrates upon one and the same portion of the photosensitive medium, which has in turn resulted in creation of wrinkled patterns on the formed image. Also, the considerable pressure under which the drum cleaner is urged against the drum has caused physical deformation of the same part of the photosensitive medium.

Thus, drawbacks are pronounced when a non-endless (non-seamless) photosensitive medium is employed. However, the adverse effect of the cleaner on the photosensitive medium may be eliminated by using a photosensitive member formed with a seam and positioning the seam adjacent to the cleaner.

On the other hand, when an endless (seamless) photosensitive medium is employed, the merit that the photosensitive medium may be started from any position thereof precludes the above-described countermeasure against the cleaner. Moreover, in the case where the copy process is controlled by a signal generated at the rotational position of the seamless drum, the stop position of the drum is periodically fixed and this prevents elimination of the said adverse effect on the photosensitive drum.

Further, such adverse effect is more pronounced as the drum is smaller in size, and there is no apparatus which has eliminated this drawback.

Also, the conventional apparatus in which the copy cycle is controlled by the rotational position of the drum has sometimes suffered from loss of scanning time depending on the copy size and this has not been effective.

Furthermore, the conventional use of microswitches, relays or the like for the control of the copy cycle, detection of jam, etc. has often led to malfunctioning and has been poor in reliability.

Still furthermore, there has been no copying apparatus of the image transfer type which is compactly designed and excellent in image formation as well as safe and reliable in operation.

SUMMARY OF THE INVENTION

It is an object of the present invention to provide a copying apparatus in which suitable clock pulses are generated per complete rotation of an endless photosensitive drum to thereby change the stop position and the start position of the drum moment and avoid the accumulation of the aforesaid adverse effect upon the photosensitive medium, thus enabling the photosensitive medium to be uniformly used throughout its entire length and elongating the service life of the photosensitive medium.

It is another object of the present invention to provide a copying apparatus which eliminates having an untreated portion from the photosensitive medium during the pre-treatment and the post-treatment effected before and after a copy cycle and which enables a copy cycle to start from any desired portion of the photosensitive medium by use of an endless drum.

It is still another object of the present invention to provide a copying apparatus in which control of the copy cycle is not performed only by the rotation of the drum or the control means associated therewith but by a combination of a reverse signal of the original carriage or the optical system corresponding to the copy size, a clock pulse corresponding to the rotation of the drum and a counter and with the reverse signal as the reference, whereby the scanning distance of the original carriage or the optical system may be varied in accordance with the copy size and the copy cycle may be renewed at the reverting position to thereby reduce the loss of time involved in the return of the original carriage or the optical system.

It is yet still another object of the present invention to provide a copying apparatus which is provided with jam detector means for effectively detecting any delay of copy paper on its way to the detector and any stagnation of the paper on the detector with the aid of the paper detection signal from a copy paper detector installed in the vicinity of the paper discharge port.

It is a further object of the present invention to provide a copying apparatus which, even if the main switch is opened during the post-treatment, may accomplish the copy process by maintaining a necessary power source until the post-treatment is completed.

It is a further object of the present invention to provide a copying apparatus which employs no-contact magnetic detector elements as almost all of the elements for the detection of the position of the original carriage and similar purposes and frequently uses a digital IC as the control circuit and semiconductor switching elements as the driving switches for the terminal elements of the control circuit, whereby compact construction of the apparatus and complicated sequence control may become feasible while the chattering resulting from relays or the like may be eliminated to extremely enhance the reliability of the apparatus.

It is a further object of the present invention to provide a copying apparatus which is less expensive, easy to maintain and high in safety as well as excellent in image formation, in spite of the small size of the photosensitive drum and the compact construction of the apparatus which are attributable to the utilization of the endless configuration of the drum.

Thus, one feature of the apparatus of the present invention is that it employs an endless photosensitive drum and has a pulse generator for generating pulses having a predetermined pulse interval corresponding to the rotation of the photosensitive drum, whereby control of each cyle is effected by the pulses and a counter device associated therewith and control of the copy cycle is carried out by combination of signals representing the positions (reverting position, home position, etc.) of the original carriage or the optical system and the above pulse signals and further, the counter is reset by the reverting position signal or the like. For example, the above-mentioned clock pulse generator is designed to generate 15.75 pulses per complete rotation of the drum. Thus, the counter counts sixteen clock pulses to thereby enable the drum to make one complete rotation and some more. This is useful to prevent localized accumulation of electric charges or localized deposition of toner particles on the surface of the small photosensitive drum.

The apparatus of the present invention is also provided with a paper feed cassette, first signal generator means installed on the cassette table on which the cassette is placed, and second signal generator means corresponding to various copy sizes and disposed on the scanning path along which the object to be copied and the optical system are moved relative to each other, whereby control of the scanning distance of the original carriage may be accomplished by logically selecting one of the second signals with the aid of the first signal.

A further feature of the present invention is that a magnet is attached to the movable portion of each of the devices such as liquid quantity detector, clock pulse generator, copy command button, copy board, and detectors at home position, paper feed start timing signal generating position, B5 size reverting position, A4 size reverting position and B4 size reverting position, so that the variation in the intensity of magnetic flux resulting from movement of the magnet may be detected at a specific position without making any contact and by utilizing the Hall effect or the resistance variation of semiconductor caused by the magnetism.

According to the present invention, there is further provided a novel door switch so that the main switch may not be closed unless the door of the apparatus is completely closed, whereby safety is enhanced.

The above objects and features of the present invention will become more fully apparent from the following detailed description of the invention taken in conjunction with the accompanying drawings.

BRIEF DESCRIPTION OF THE DRAWINGS

FIG. 15-b is a time chart therefor.

FIG. 16-b is a time chart therefor.

FIG. 16-c shows the waveforms for clearing the counter.

FIG. 21-b is a time chart therefor.

FIG. 22-b is a time chart therefor.

FIG. 24-b diagrammatically shows a jam timing signal generatjng circuit.

FIG. 24-c is a time chart therefor.

DESCRIPTION OF THE PREFERRED EMBODIMENTS

Figure 1:
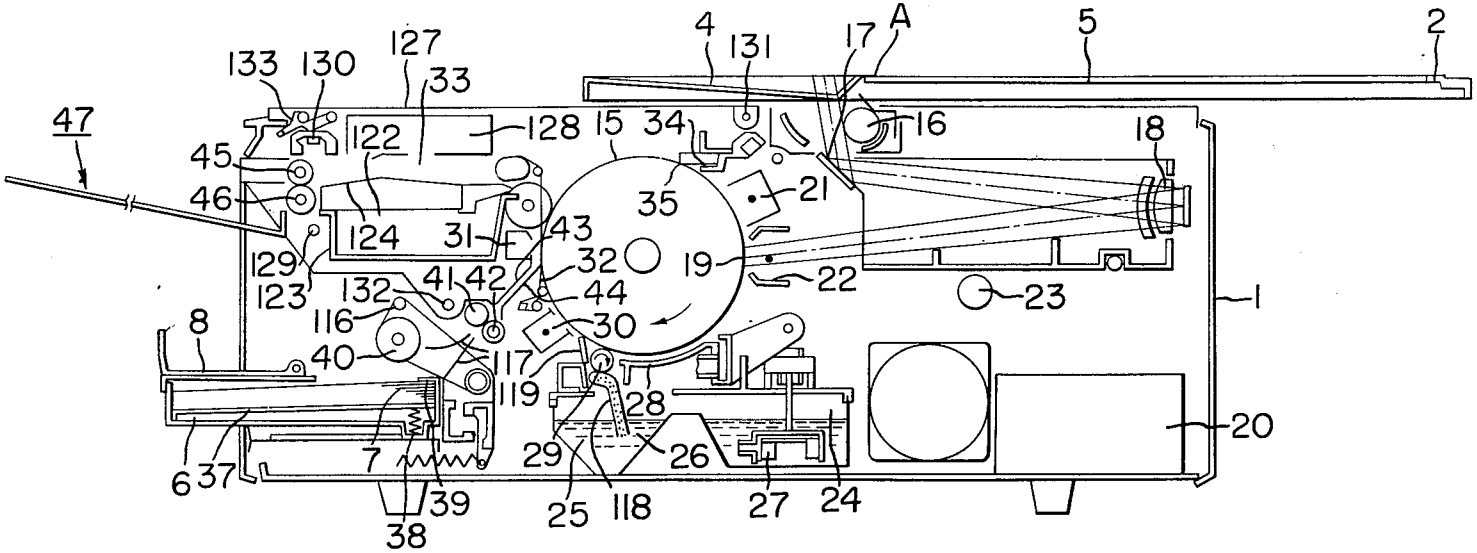
FIG. 1 is a longitudinal cross-section of the copying apparatus according to the present invention.

Operation of the copying apparatus will first be described with reference to FIGS. 1 and 2.

When a main switch is first closed, a photosensitive drum 15 which will further be described begins to rotate in a very short time (herein, about one second) after the closing of the main switch because a digital circuit used in the apparatus necessitates such time for the resetting of the controller section therefor and the rising of other electrical systems. It is recalled here that a clock pulse generating mechanism is provided in a portion of the drive system so as to generate a clock pulse sixteen times per complete rotation of the photosensitive drum. Therefore, the photosensitive drum 15, which has so begun to rotate, first makes one complete or substantially one complete rotation corresponding to sixteen clock pulses (hereinafter referred to as "16CP, etc."). This may be regarded as the pre-stage before the copy process is begun, and is provided for good reproduction once the copy process has begun, and may sometimes be omitted. If a copy button is not depressed then, the photosensitive drum will stop without any further rotation than one complete rotation, but if the copy button is depreseed, the drum will begin the copy process without stopping its rotation. When the copy button is depressed, the photosensitive drum 15 will first rotate by an amount corresponding to the above-mentioned 16CP plus 4CP, and only then, an original carriage 2 with an original placed on a glass plate 5 thereof is started and illuminated by an illuminating lamp 16, so that the image of the original is directed via a mirror 17 and an in-mirror lens 18 to an exposure station 19, where it is imaged on the drum 15.

The surface of the photosensitive drum 15, that is, the photosensitive medium having a photosensitive layer covered with a transparent insulating layer, is first charged to the positive polarity by a positive charger 21 supplied with a high voltage from a high voltage source 20. Subsequently, when the drum reaches the exposure station, the image of the object illuminated by the illuminating lamp 16 as described above is projected upon the photosensitive drum 15 through a slit. Simultaneously therewith, the photosensitive medium is subjected to AC charge by an AC charger 22 supplied with a high AC voltage from the high voltage source 20. Through an allover exposure subsequently effected by an allover exposure lamp 23, an electrostatic latent image with high contrast is formed on the surface of the drum, whereafter the drum begins the developing step. A developing device 24 comprises a container 26 for developing liquid 25, a pump 27 for stirring the developing liquid and for elevating the developing liquid onto a developing electrode portion, a developing electrode 28, and an electrode roller 29 rotatable in close proximity to the drum to remove any fog which may be present in the visualized image on the drum and having one end grounded. The developing electrode 28 always maintains a predetermined spacing with respect to the photosensitive drum 15, and the electrostatic latent image formed on the photosensitive drum 15 is developed into a visible image by the toner in the developing liquid elevated onto the developing electrode 28 by the pump 27.

Next, the photosensitive drum 15 is charged by a post-charger 30 supplied with a (negative) high voltage from the high voltage source 20 so that any excess developing liquid on the drum 15 is removed without the image thereon being disturbed. Subsequently, a sheet of transfer paper 7 fed from a paper feed station is brought into intimate contact with the photosensitive drum 15, and the image on the drum 15 is transferred onto the transfer paper 7 by a transfer charger 31 with the aid of an electric field provided by the (positive) high voltage from the high voltage source. After the image transfer, the transfer paper 7 is separated from the photosensitive drum 15 by a separator belt 32 and directed to a drying-fixing station 33. The photosensitive drum 15 has the residual developing liquid wiped off by the edge portion 35 of a blade cleaner 34 urged against the drum surface, in preparation for a subsequent copy cycle. That amount of the developing liquid wiped off by the blade cleaner 34 is directed through grooves 36 (FIG. 3), formed on the opposite end portions of the drum 15, to the developing 24 device for reuse.

Description will now be made of the reason why the original carriage 2 is not started until the photosensitive drum has been rotated by an amount corresponding to 16CP, upon the closing of the main switch 10 (FIG. 2), plus 4CP, as previously described. In the present apparatus, an endless type drum is employed as the photosensitive drum and all the surface area of the photosensitive drum is available for image formation. Thus, if it is desired to increase the number of copies produced per unit time with unnecessary rotation being saved as much as possible, it is necessary to clean the photosensitive drum during the first complete rotation thereof prior to the latent image formation, because any toner remaining on the blade cleaner edge portion 35 may have dried and adhered to the drum (in the worst case) if the drum is left unused for a long time, say, a week or ten days.

As regards the rotation of the drum corresponding to 4CP, this is necessary because, in the previously described copy process, the positive charging step precedes the slit-exposure and because more reliable copying will be attained if the section of the photosensitive drum corresponding to the aforesaid cleaner edge portion is avoided during the production of a first copy.

On the other hand, sheets of transfer paper 7 are contained within a cassette 6 which may be inserted and removably mounted in the paper feed station located at the lower and lefthand portion of the apparatus body as viewed in the figure. In accordance with various sizes of transfer paper, various types of cassette may be prepared and readily interchanged as required.

A stock of transfer paper 7 is placed on an intermediate plate 37 within the cassette 6, and the intermediate plate 37 is biased upwardly by a spring 38 so that the stock of transfer paper 7 is always urged against separator pawls 39 provided at the forward end corners of the cassette 6. By choosing a suitable spring constant for the spring 38, the force with which the stock of transfer paper 7 is urged against a paper feed roller 40 during paper feed may be made constant independently of the quantity of the transfer paper 7 within the cassette 6.

When the original carriage reaches a predetermined position, detector means on the machine body is actuated by an actuating member fixed to the original carriage to generate a signal, by which the paper feed roller 40, always in rotation, is lowered into contact with the uppermost one of the transfer paper sheets in the cassette 6, and then that uppermost transfer paper sheet is separated from the rest by separator pawls 30 and fed out of the cassette 6. However, register roller 41 and 42 located closely adjacent to the cassette have been stopped from rotating upon lowering of the paper feed roller 40 and therefore, the transfer paper sheet 7 fed out of the cassette 6 does not react guides 43 and 44 since the leading end edge thereof strikes against the nip between the register rollers 41 and 42. When the paper feed roller is about to move upwardly, the register rollers 41 and 42 resume their rotations keeping the timing with the leading end of the image on the photosensitive drum, so that the transfer paper sheet 7 is transported at a speed coincident with the peripheral speed of the photosensitive drum 15.

Thus, as already described, the transfer paper 7 is brought into intimate contact with the photosensitive drum 15 and the image on the drum 15 is transferred onto the transfer paper 7 with the aid of the transfer charger 31, whereafter the transfer paper 7 now with the image transferred thereto is separated from the drum 15 by a separator belt 32 and passed through the drying-fixing station 33 for fixation of the toner on the transfer paper 7, and finally discharged onto a discharge tray 47 by discharge rollers 45 and 46.

Operations involved in carrying out the copying will now be explained with reference to FIGS. 2 and 3. An original to be copied is placed on the glass plate 5 of the original carriage with the leading end edge thereof registered with the forward end A of the glass plate, and then held down by a keep cover 3 (FIG. 2). The copy button 13 (FIG. 2) is then depressed, whereupon the drum starts to rotate and simultaneously therewith, begins to operate. By an original carriage starting signal from the clock pulse generating mechanism after 4CP, the original carriage 2 is moved leftwardly, in FIG. 1, in synchronism with the peripheral speed of the photosensitive drum 15, thereby effecting the slit exposure. After completion of the exposure, the original carriage 2 is caused to stop its leftward movement by a signal from the carriage itself in accordance with the size of the paper in the cassette and immediately moves backwardly or rightwardly. The time required for this backward stroke should desirably be short because it is a loss of time during the copying. In the present apparatus, the speed of the return stroke is chosen to about four times that of the forward stroke to thereby enhance the copying efficiency. Such a high speed of the return stroke is liable to cause a shock at the stoppage of the carriage, but the shock is absorbed by a brake mechanism which will further be described, and the original carriage 2 is quickly stopped at a predetermined position. Continuous production of multiple copies of a common original may also be accomplished easily by means of a counter device (not shown) operatively associated with the copy button. The counter device catches the movement of the original carrier 2 to count the number of copies produced and holds a switch element until it counts up a set number of copies, whereby production of multiple copies may be accomplished.

The instruction for re-starting the original carriage during the continuous copying mode is effected by 1CP after the original carriage 2 has been stopped at a predetermined position (home position). This is meant to provide smooth movement of the original carriage at the initiation of its forward stroke. Also, the copying apparatus of the present embodiment can copy originals of various sizes from the maximum B4 size to the minimum B5 size. In such cases, the number of copies produced per unit time will be fewer and the loss of time will be greater if the original carrier 2 must always be moved over the distance for the maximum copy size B4, irrespective of the actual copy size which, as noted above is variable from B4 to B5. In the present copying apparatus, therefore, a plurality of original carriage reverse signal generating members (FIG. 4) are provided to correspond to the respective copy sizes (e.g. A4 and B5) so that the copy cycle may be changed in accordance with the copy size to thereby enhance the copying efficiency.

Such differences in copy cycle depending on the copy size may be discriminated by signals from the cassettes 6 available for the various sizes.

Description will now be made of the rest condition and the re-start of the copying apparatus after completion of a copying operation. If the apparatus is left with the power source connected thereto after a copying operation has all been completed, the photosensitive drum 15 will continue to rotate and the high voltage source being left connected will be undesirable in respect of the durability of the photosensitive drum 15 and the blade cleaner 34. For this reason, the copying apparatus of the present embodiment is designed such that, if no copying opeation occurs in a predetermined time after completion of a copying operation, the photosensitive drum automatically stops and enters into its rest condition even if the main switch 10 is left in closed position. The predetermined time is selected to be a longer time than that required for a sheet of transfer paper 7 with a transferred image to be discharged out of the apparatus and for the entire surface of the photosensitive drum 15 to be cleaned up. To re-start the copying operation from such rest condition, the copy button 13 in the operating section 9 may be depressed, whereby all moving parts of the apparatus are restored to their operative conditions and the photosensitive drum begins to rotate and after 4CP, the original carriage 2 starts its forward movement. In the present copying apparatus, the rest condition is entered 26CP after the original carriage reversing instruction for the last copy cycle has been given.

The copying apparatus of the present embodiment will now be explained with respect to specific construction thereof.

Figure 3:
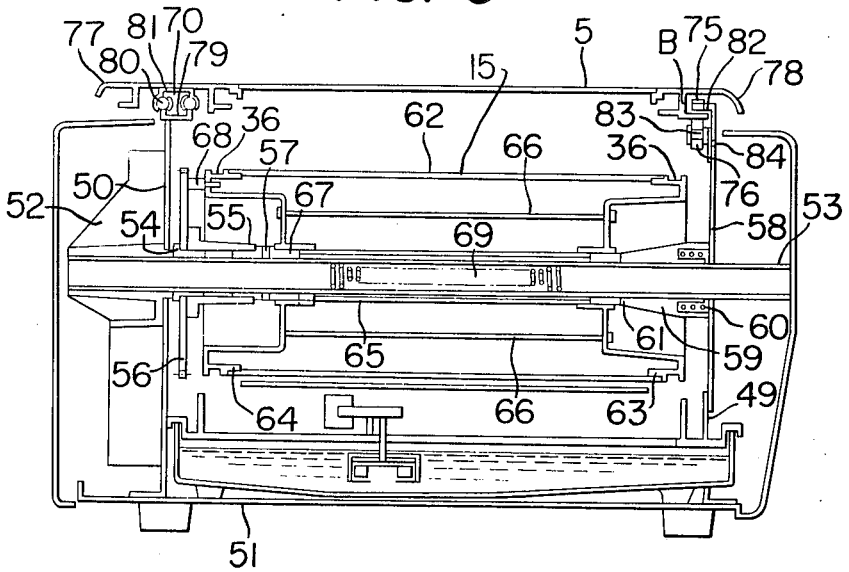
FIG. 3 is a vertical cross-sectional side view corresponding to FIG. 1.

Referring to FIG. 3, reference numerals 49 and 50 designate front and rear frames rigidly joined together by stays (not shown) and bottom plate 51.

A drum shaft fixing member 52 formed of alloy casting is secured to the rear frame 50 substantially centrally thereof, and a drum shaft 53 is fixed to the member 52.

The drum shaft fixing member 52, as is shown in FIG. 3, is secured to the rear frame 50 with a great spacing therefrom and, in spite of its substantially cantilevered condition, the fixing member is constructed with sufficient strength to withstand the weight of the drum 15 and other forces. A drum gear 56 is rotatably supported on the drum shaft 53 by means of bearings 54 and 55. A bearing keep fitting 57 is secured to the drum shaft 53 by set screws and as will further be described, the keep fitting keeps the drum gear 56 and the bearings 54, 55 against detachment when the drum 15 is removed. The other end (the right end in FIG. 3) of the drum shaft 43 is substantially horizontally supported by a support plate 58. The support plate 58 is positioned by two positioning pins so as to permit the drum to be removed as will later be described, and is removably secured to the frame 49 by two nuts. The support plate 58 is provided with a thrust keep member 59 which is movable in the thrust direction to force, leftwardly in FIG. 3, a bearing 61 held on the drum by a spring 60, thereby eliminating any backlash of the photosensitive drum 15 in the thrust direction. The photosensitive drum is formed by a drum 62, a front flange 63, a rear flange 64, a guide pipe 65, two rods 66, and bearings 61 and 67 forced into the front and rear flanges 63 and 64, and is assembled with the drum 62 interposed between the front and rear flanges 63 and 64 and tightened by the rod 66. The guide pipe 65 serves to guide the drum so as to permit the drum to be easily mounted or dismounted along the drum shaft 53. The rear flange 64 is formed with an opening for engagement with a drive pin 68 secured to the drum gear 56. The engagement between the opening and the drive pin rotatively drives the drum. Owing to the above-described quasi-cantilevered support for the drum, the photosensitive drum may be constructed with sufficient strength and compactness and may be assembled and disassembled with ease. The drum shaft 53 may be secured to the machine body and formed by a hollow pipe, in which a heating member 69 is installed to maintain the photosensitive medium at a predetermined temperature to thereby prevent condensation of moisture during high humidity condition and also enable image reproduction of good quality to be attained in low-temperature environments.

Figure 4:
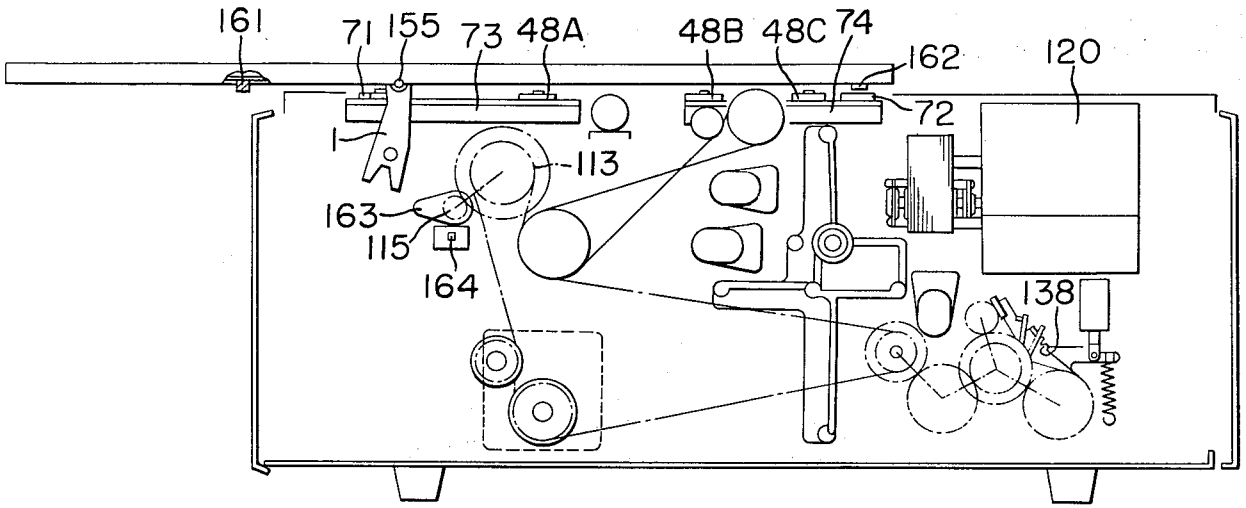

Secured to the upper end portion of the rear frame 50 is a guide rail 70 and members 73 and 74 to which magnetic detector elements 48A, 48B, 48C, 71 and 72 for control signals may be attached (FIGS. 3 and 4). Installed in the upper end portion of the front frame 49 are guide rollers 75 and 76 as shown in FIG. 3, so that these guide rollers are cooperable with the guide rail 70 to effect smooth reciprocation of the original carriage 2. The original carriage has a front 78 and a rear angle 77 coupled together by a stay and forms a frame member which is sufficiently rigid against various forces produced during the forward and backward movement or the reversal of the original carriage. Provided centrally of the framework is a transparent glass plate 5, and disposed forwardly (leftwardly in FIG. 1) of the framework is a platform 4 which assists a page of a book or the like to be copied in making good contact with the surface of the glass plate with another page of the book resting on the platform, and these also contribute to the making of the original carriage.

The rear guide rail 70 is constituted by a lower rail 79 secured to the rear frame 50 by means of mounting members 73 and 74, an upper rail 81 secured to the rear angle 77 of the original carriage, and a retainer disposed intermediately between the upper and the lower rail and having metal balls 80 held for rolling movement, and restricts the vertical position and the horizontal position (left and right in FIG. 3) of the rear angle 77 of the original carriage. The reciprocal movement of the orginal carriage is guided by the rolling movement of the metal balls 80. On the other hand, the projected rail portion 3 of the front angle 78 of the orginal carriage restricts the vertical position of the original carriage by being nipped between the lower guide roller 76 and the upper guide roller 75. The guide rollers 75 and 76 are rotatably held on shafts 82 and 83 which are secured to a mounting plate 84 and firmly held by the front frame 49.

Thus, with the vertical and horizontal (left and right in FIG. 3) positions of the original carriage restricted by the rear guide rail 70 and with only the vertical position of the front angle of the carriage restricted by the guide rollers 75 and 76, the reciprocal movement of the original carriage may be accomplished very smoothly irrespective of the manufacturing and assembly errors of the apparatus.

Magnetic detector elements 48A, 71, 72, 48B and 48C are secured to the guide rail mounting beds 73 and 74, and they produce control signals in succession with the aid of magnets 161 and 162 attached to the original carriage 2. When the copy button is now depressed to cause the original carriage 2 to start its forward movement, a paper feed instruction is given out by the magnet 161 and the element 71. The original carriage is further moved forwardly to complete exposure for any of the copy sizes B5, A4 and B4 and the magnet 161 reaches the element 48A, 48B or 48C, whereupon a reverse instruction is given out to shift the original carriage 2 from its forward movement to its backward movement. When the magnet 162 reaches the element 72 with the progress of the backward movement of the original carriage, a stop instruction is given out to stop the carriage at a predetermined position. A size change instruction may be given out from the cassette 6.

Figure 5:
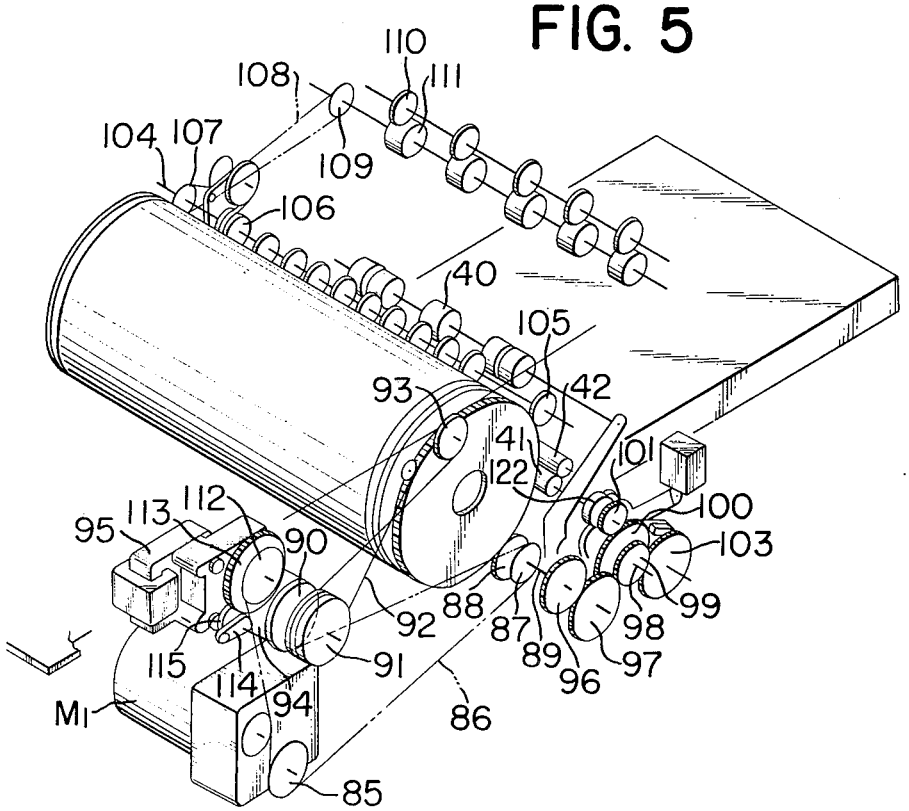
FIGS. 4 and 5 are a cross-sectional view and a perspective view, respectively, showing the drive relationship in the copying apparatus of the present invention.
Figure 9:
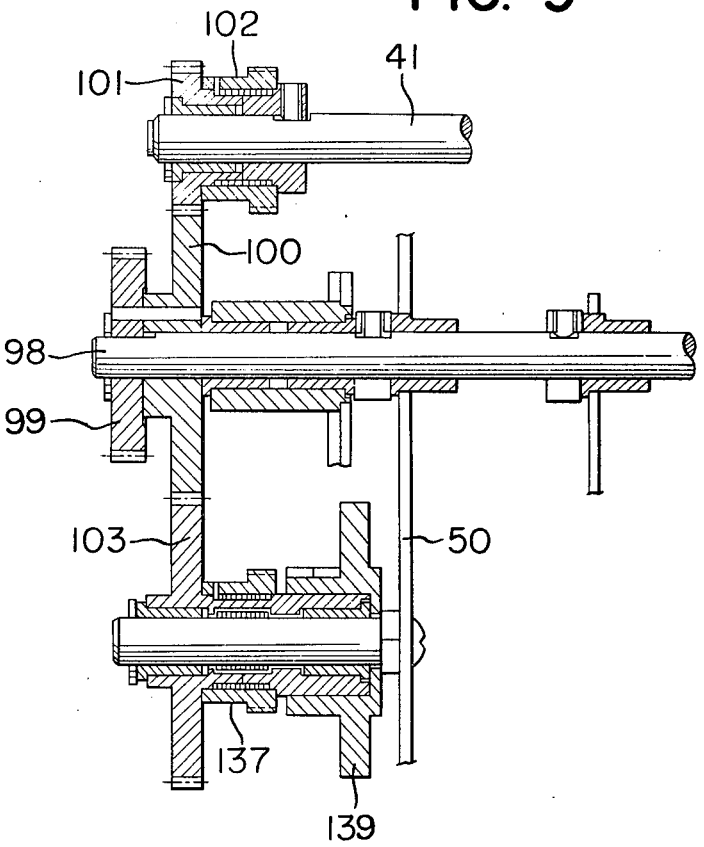
FIG. 9 shows, in cross-section, the driving section for the paper feed device.
Figure 10:
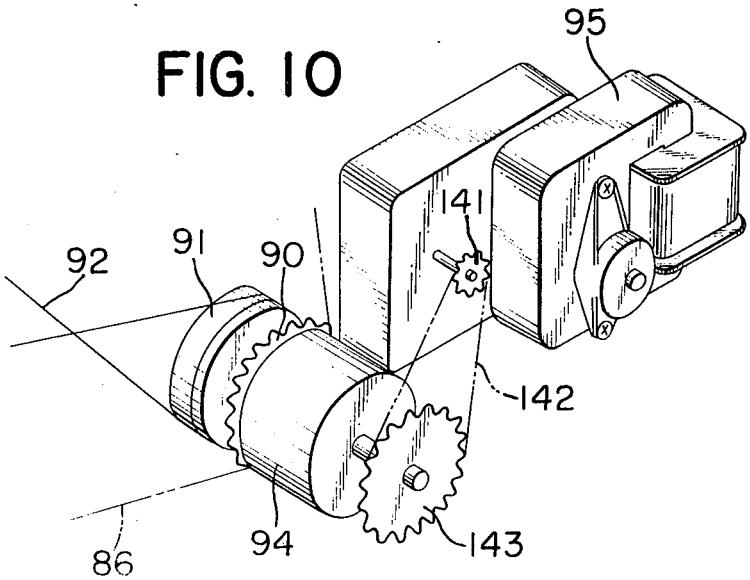
FIG. 10 shows, in perspective view, the driving section for the original carriage.

Reference will now be had to FIGS. 5, 9 and 10 to explain the drive relationship. The drive of the main motor M1 is transmitted by a sprocket wheel 85 and through a chain 86 and a sprocket wheel 87 to drive a drum driving shaft 89 at one end of which is securely mounted a gear 88 which is in meshing engagement with the aforementioned drum gear 56. The chain 86 further drives a sprocket wheel 90 rotatably mounted on the shaft of an electromagnetic clutch 94. On the back side of the clutch 94, a ladder wheel 143 is secured to the shaft of the clutch (FIG. 10). The ladder wheel 143 is connected by a ladder chain 142 to a ladder wheel 141 secured to the output shaft of a clutch motor 95. Mounted on the other end of the magnetic clutch shaft is a winding drum 91 on which an original carriage driving wire 92 is wound for several turns, and the opposite ends of the wire are guided by a guide pulley 93 and respectively secured to the forward and rearward ends of the rear angle 77 forming part of the original carriage.

The reciprocal movement of the original carriage 2 may be effected by driving the electromagnet 94 and the clutch motor 95 in a change-over fashion to rotate the winding drum in normal and reverse directions and thereby reciprocate the original carriage. A gear 96 is securely mounted on the drum driving shaft 89 to transmit the drive of the main motor M1 through a gear 97 to a gear 99 securely mounted on a paper feed roller driving shaft 98. The drive of the main motor M1 also drives a gear 101 through a gear 100 secured integrally with the gear 99, and further drives the register rollers 41 and 42 through a clutch 102. The gear 100 is also in meshing engagement with a gear 103 and drives a paper feed roller control cam 139 through a clutch 137. The drum gear 56 (FIG. 3) is in meshing engagement with a gear 105 secured to a separator shaft 104 and drives separator rollers 106. A ladder wheel 107 is securely mounted at the other end of the separator shaft 104 and drives discharge rollers 110 and 111 through a ladder chain 108 and a ladder wheel 109. A sprocket wheel 112 driven through the chain 86 from the sprocket wheel 85 attached to the main motor M1 has a gear 113 secured integrally thereto, which gear 113 is in meshing engagement with a gear 115 secured to an arm 114 holding a clock pulse generating magnet 163 (FIG.4) and rotates the magnet so that clock pulse at a predetermined interval which is synchronous with the rotational speed of the main motor M1 are generated by the magnet and the magnetic detector element 164 (FIG. 4) fixed with respect to the rear frame 50. The pulse number corresponds to 15.75 times for one complete rotation of the drum. Designated by 138 in FIG. 4 is a paper feed control section which is such that, when the original carriage 2 is forwardly moved to a predetermined position after depression of the copy button 13, a paper feed signal is generated to lower the normally rotating paper feed roller 40 to feed one of the sheets of transfer paper from within the cassette 6. The leading end edge of the transfer paper so fed strikes against the register rollers 41 and 42, which have been stopped from rotating simultaneously with the lowering of the paper feed roller 40, so that a loop of transfer paper is formed between the guides 117 (FIG. 1). Then, the paper feed roller 40 is elevated and the register rollers 41, 42 resume their rotation, whereby the transfer paper 7 is transported in the machine at a speed coincident with the peripheral speed of the photosensitive drum 15.

Figure 12:
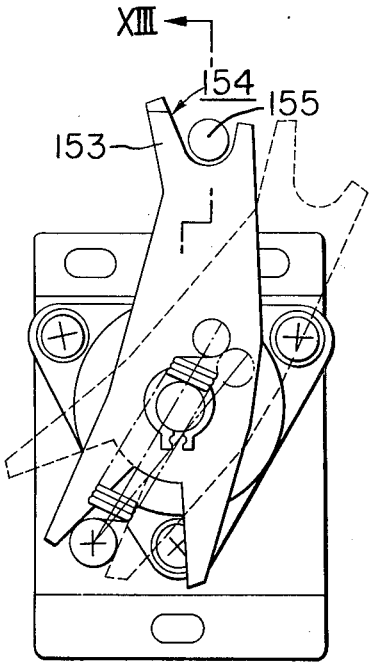
FIGS. 12 and 13 show, the cross-section, the device for stopping the original carriage.
Figure 13:
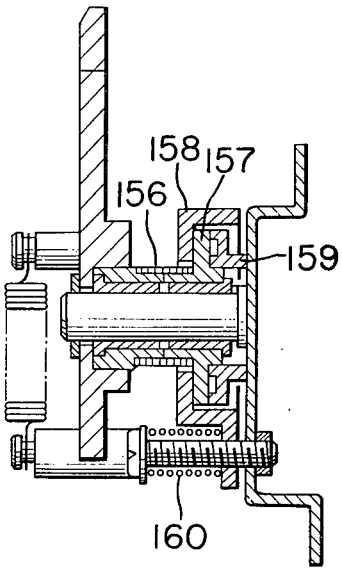

The original carriage is moved forwardly and backwardly by the driving system as described above, and in the copying machine of the shown embodiment, the speed of the backward movement of the carriage is selected to about four times (about 200 mm/sec.) that of the forward movement in order to enhance the copying efficiency, namely, to reduce the loss of time during the backward stroke. To enable the original carriage moving at such a high speed to be stopped at a predetermined position in the machine body without imparting any shock, the present machine has a lock mechanism as shown in FIG. 12. The lock mechanism comprises a combination of a one-way clutch and a brake. In FIG. 12, the lock lever position indicated by solid line shows the reset condition of the original carriage. A pin 155 secured to the rear angle 77 forming part of the original carriage 2 is in engagement with a cut-away portion 154 formed in the lock lever 153. Now, when the original carriage 2 starts to move forwardly (rightwardly in FIG. 4) in response to the original carriage start instruction, the lock lever 153 is forced to rotate clockwise, as viewed in FIG. 12, by the pin 155. When this occurs, the brake disc 157 (FIG. 13) remains stationary because the one-way clutch 156 is out of engagement, and thus the friction force between the brake disc 157 and the brake shoes 158, 159 provides no resistance against the movement of the original carriage 2. As the carriage 2 is further moved forwardly, the lock lever 153 stops at the position as indicated by broken outline. When the original carriage 2 has reached its predetermined position and a reverse instruction is given out, the carriage stops its forward movement and reverts to its backward movement toward the home position at a speed four times that of the forward movement. The pin 155 engages the cut-away portion 154 of the lock lever 153 to rotate the lock lever counter-clockwisely from the broken-line position to the solid-line position, whereupon the brake disc 157 is caused to rotate counterclockwise by the one-way clutch 156. The brake disc 157 is nipped by and between the brake shoes 158 and 159 and has a pressure exerted thereon by a spring 160, so that the original carriage can be stopped with the inertia thereof absorbed by the friction force and without any great shock imparted to the original carriage. Because of such construction, there is little or no load during the start of the original carriage and a sufficient brake force may be exerted on the carriage for stopping same.

Figure 2:
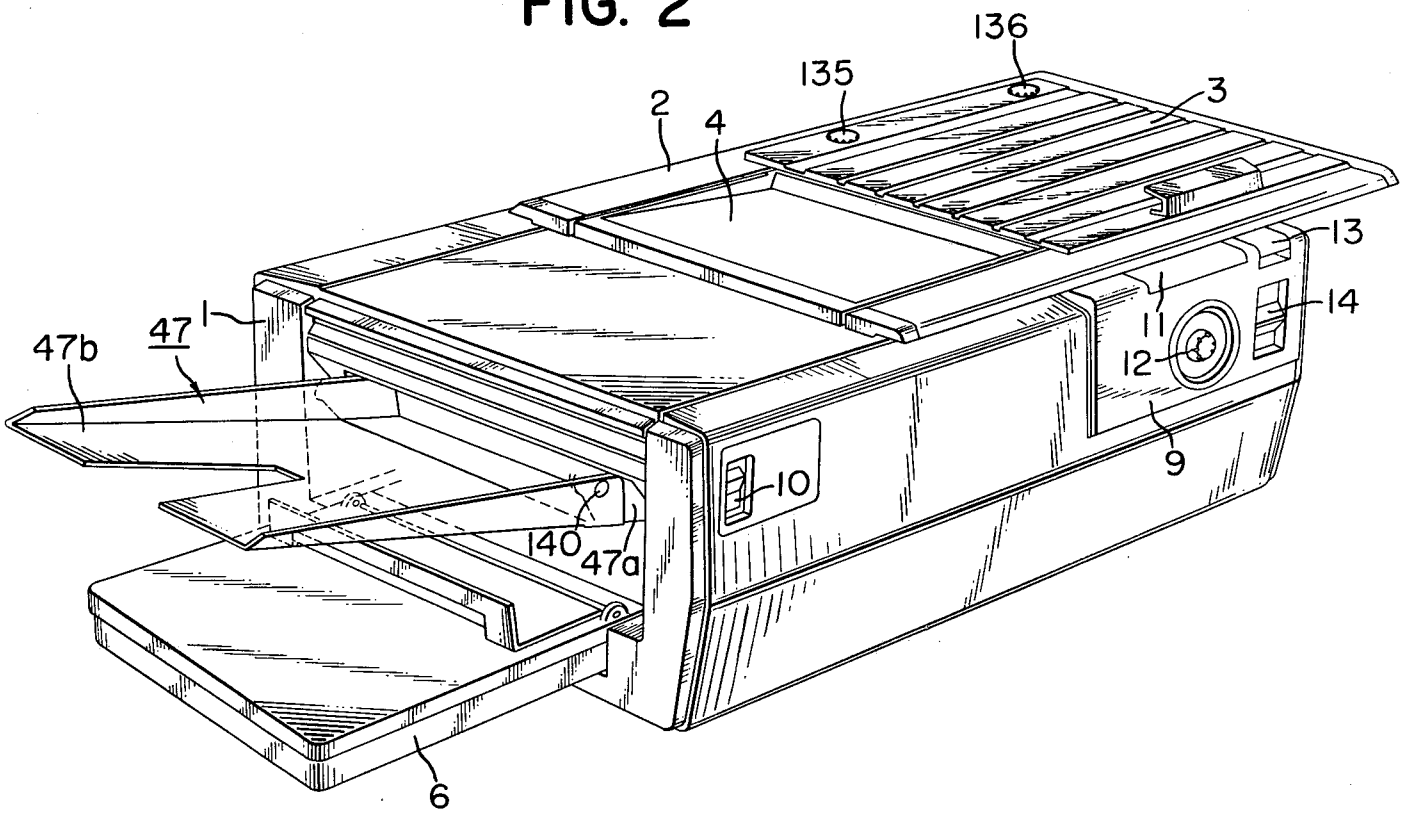
FIG. 2 is a pictorial perpective view of the apparatus.

With reference to FIGS. 1 and 3, description will be made of the developing device in the copying machine of the shown embodiment. In FIG. 1, the developing liquid 25 stored in the developing tank 26 is supplied into the clearance between the photosensitive drum 15 and the developing electrode 28 by the pump 27 to develop the latent image on the photosensitive drum 15 into a visible image by the toner in the developing liquid. After the development, the drum surface has any fog thereon removed by a fog removing roller 29 disposed adjacent thereto. The fog removing roller 29 is rotated with a relative velocity to the surface of the photosensitive medium by an unshown drive source, and the surface of the fog removing roller is normally cleaned by a cleaning member 118. A scraper 119 is located behind the fog removing roller 29 and makes pressure contact with the photosensitive medium to remove the developing liquid from the surface area of the photosensitive medium which corresponds to the separator belt, thus preventing the separator belt from being contaminated by the developing liquid.

Figure 8:
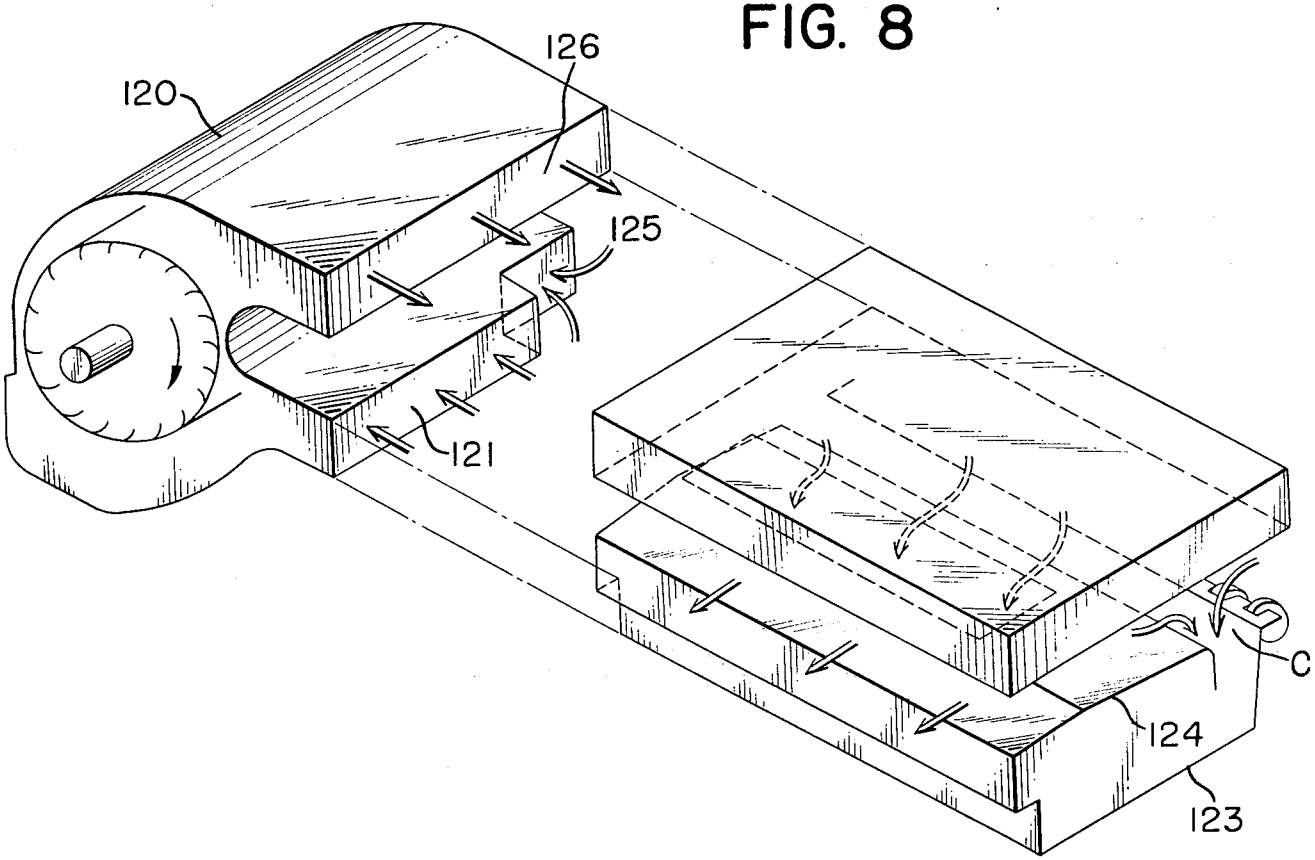
FIG. 8 is a perspective view of the fixing device.

As already described, the transfer paper 7, which has been fed from the cassette and had the image transferred thereto from the photosensitive drum and separated from therefrom, is directed to the fixing station where it is dried for fixation of the transferred image by the heat from a hot plate. In FIGS. 4 and 8, a cross flow fan 120 is fixed to the rear frame 50, and has a first suction port 121 engaged with a transporting section 122 to take in the air through an opening C and through a duct formed by a duct plate 123 and a hot plate 124. This air stream assists in separation of the transfer paper from the drum surface by the separator belt 32 (FIG. 1) and also enhances the intimacy of the contact of the transfer paper with the hot plate. The fan 120 has a second suction port 125 which is not engaged with the transporting section but takes in the air from outside.

The cross flow fan 120 has an air outlet 126 through which the air is directed over the hot plate 124 through an outlet duct 128 (FIG. 1) situated above the hot plate and secured to an upper cover 127, thereby contributing to the transport and drying of the transfer paper. Such use of a single fan both for suction and blow-out is effective to reduce the size and cost of the apparatus, and the semi-circulating system formed thereby eliminates the possibility of the transfer paper surface being covered with saturated steam and provides a good drying effect.

Operation during bad condition of the paper feed will now be discussed. The copying apparatus of the present embodiment has jam detector means for confirming whether or not transfer paper has passed through prescribed steps of the process (paper feed, image transfer, separation and fixation) and been discharged out of the machine within a predetermined time, and is designed such that if the transfer paper accidentally comes to a halt during the above-mentioned steps of the process and fails to discharge out of the apparatus within a predetermined time, the apparatus is stopped so as not to cause a fire or other accidents. In FIG. 1, reference numerals 129 and 130 designate a light-emitting element and a light-sensing element, respectively. As will further be described, these elements detect the arrival of transfer paper after the prescribed pulse by the clock pulse generating mechanism has been counted from the original carriage reverse instruction. When a jam is detected, the heater in the fixing device is electrically cut off and the main motor M1 is deenergized to stop the drum 15 while the original carriage 2 moves back to its predetermined position (home position) and then stops there. When the apparatus is stopped from operating, the upper cover 127 which may be opened by pivoting about a hinge 131 in FIG. 1 is opened substantially to its upright position, with the duct 128. If nothing is then found on the hot plate 124 but a jam has occurred in the fixing station, the jammed transfer paper may easily be removed manually by opening the upper cover 127. The body 122 of the transfer paper transporting section including the hot plate 124, with the separating section including the separator belt 32, is pivotally supported on a shaft 132 and normally held in place by a lock mechanism 133. By removing the lock mechanism after the upper cover 127 has been opened, the body 122 may be pivoted counter-clockwise about the shaft 132, wherebby the transfer paper passageway succeeding the register rollers 41,42 may be opened to readily permit the jammed transfer paper to be removed manually. At this time, the separator belt 32 is disengaged from the photosensitive drum so as to readily permit any transfer paper jammed there to also be removed.

After the jammed transfer paper has been removed, a jam release operation is effected and the upper cover 127 is closed, whereby all the apparatus restores its original condition. If an effort is made to close the upper cover 127 without effecting the jam release operation, the upper cover will not close and a door switch 202 (FIGS. 6 and 7) will not operate and thus, the apparatus will not be restored to its operative condition. By doing the above-described confirmation, greater safety may be ensured.

The door switch will incidentally be explained. After the apparatus is stopped with the paper jam detector becoming operative, and when a door 201 is opened in FIG. 6, an arm 202 is pivoted about a shaft 203 from the broken-line position to the solid-line position by the tension of a spring 204. When this occurs, a lever 206 pivotally supported on a shaft 205 secured to the arm 202 is also moved from the broken-line position to the solid-line position to open the microswitches $207_1$ and $207_2$, thus disconnecting the apparatus from its power source. Also, a switch plate 217 secured to a door 216 bears against the lever 206 and will provide a fulcrum about which the lever 206 may pivot when the door 201 is opened.

Figure 6:
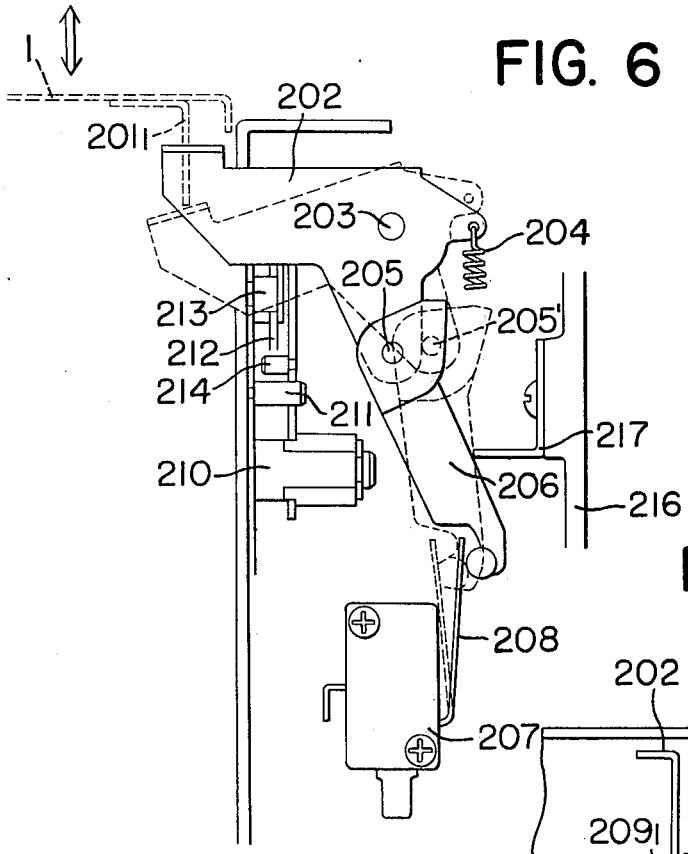
FIGS. 6 and 7 are fragmentary sectional view illustrating the operation of the safety device.

Further, even when the door 201 is in closed position, if the door 216 is moved rightwardly in FIG. 6, the lever 206 will be rotated counter-clockwise about a shaft 205' in FIG. 6, thus opening the microswitches $207_1$ and $207_2$.

With the above-described construction, opening and closing of the two doors different in direction of opening and closing movement may be detected by the same switch to thereby cut off the power supply.

Figure 7:
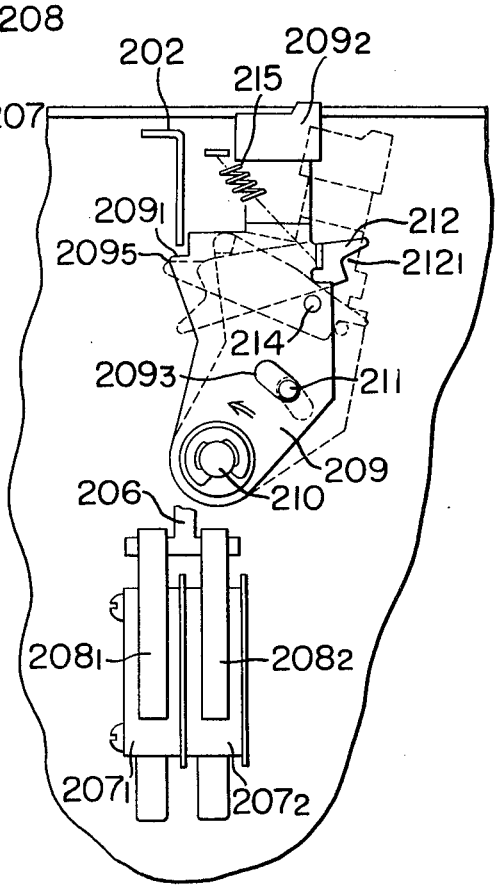

A lock arm 209 is normally biased by a spring 215 for rotation about a fixed shaft 210 in the direction of arrow in FIG. 7. When the arm 202 is moved to the solid-line position, a cut-away portion $209_1$ of the lock arm 209 comes to underlie the arm 202 to stop the arm 202. In such position, even if an effort is immediately made to close the door 201 without eliminating the cause of the accident and without effecting the operation of confirmation, the arm member 202 for preventing the closing of the door will be immovably arrested at the solid-line position by the lock arm 209, thus preventing the door 201 from being closed.

To restore the apparatus to its original condition, the cause of the accident is eliminated, whereafter the head $209_2$ of the lock arm 209 is pushed and rotated from its solid-line position to its broken-line position in FIG. 7, whereupon a pin 214 secured to the lock arm 209 engages a cut-away portion $212_1$ of a stop lever 212 to stop the lock arm 209 at its broken-line position and bring the lock arm cut-away portion $209_1$ out of engagement with the arm 202.

Thereafter, the door 201 is lowered, whereby the arm 202 is forced from its solid-line position to its broken-line position by a plate 217, so that the microswitches $207_1$ and $207_2$ are closed and the power source is connected, thus restoring the apparatus to its original condition. When the arm 202 shifts from its solid-line position to its broken-line position, the stop lever 212 is rotated about the shaft 213 to bring the cut-away porton $212_1$ out of the engagement with the pin 214 on the lock arm 209, which is thus rotated counterclockwise by a spring 215 until the end $209_5$ of the lock arm strikes against the arm 202 and is stopped thereby. The grooved portion $209_3$ of the lock arm 209 is engaged by the pin 211 to restrict the movement of the lock arm 209.

Due to the above-described construction in which the door can be simply opened during occurrence of an accident such as paper jam or the like but cannot immediately be closed, and by effecting the operation of confirmation, safety may be ensured.

Figure 11:
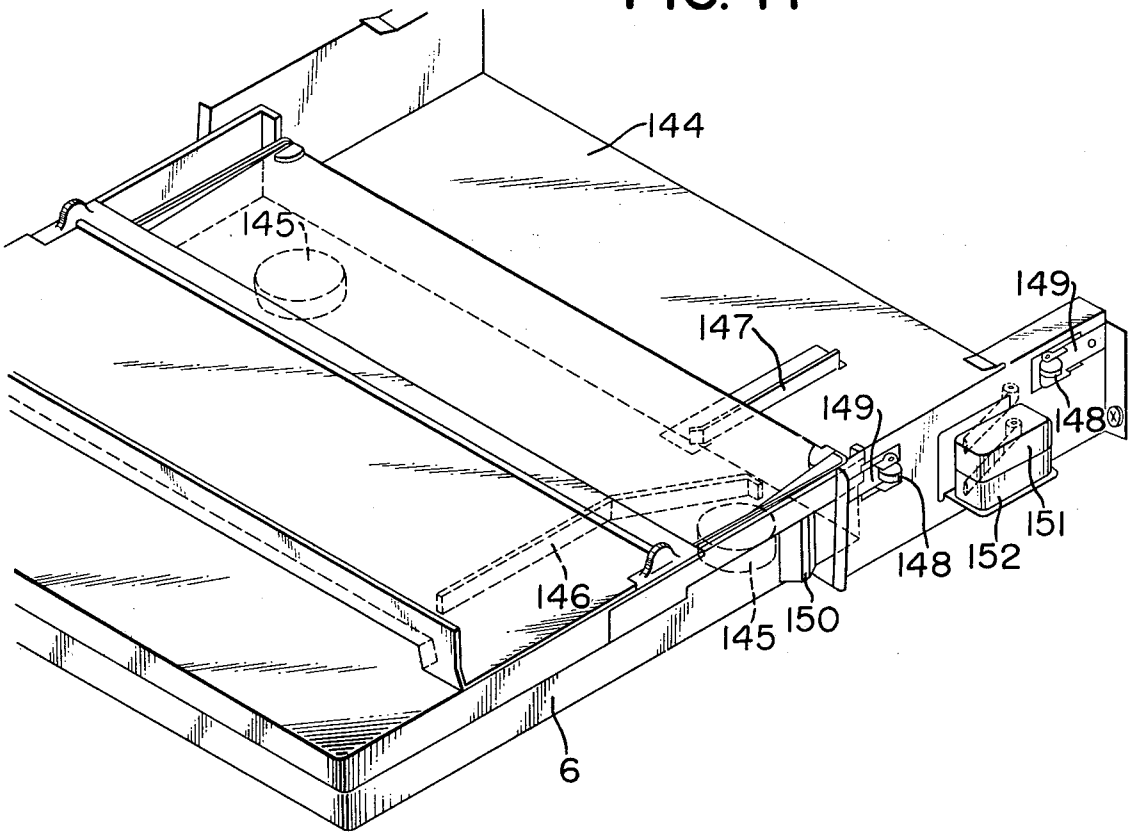
FIG. 11 is a perspective view of a cassette.

Reference will now be had to FIG. 11 to describe how to mount the cassette with respect to the machine body 1. The legs 145 of the cassette 6 are placed on a cassette supporting table 144 secured to the appartus body, and then the cassette is forced into the apparatus body, whereby the cassette 6 is biased and mounted at a predetermined position by a spring 149 having a roller 148, with the lower projected portion 146 of the cassette bearing against a positioning plate 147 on the cassette supporting table. At this time, a cassette mount signal and a size change signal are given out by a cam 150 provided on a side wall of the cassette and microswitches 151 and 152 installed on the cassette supporting table 144. An original keep cover is secured to the original carriage by means of screws 135 and 136 (FIG. 2), and may be easily removed if a three-dimensional original of large volume is to be copied. A paper discharge tray 47 is located rearwardly of paper discharge rollers 45,46 and slightly upwardly inclined (as shown in FIG. 2). The paper discharge tray 47 has a hook portion **47*a* and a tray portion 47*b* pivotally mounted by means of screws 140, and is fixed with the tray portion 47*b* pivoted substantially to its upright position. With such construction, the cassette 6 may be easily mounted and dismounted without the need to remove the whole paper discharge tray 47** from the apparatus body.

Since the guide rail 70 is installed at a lateral position as shown in FIG. 3, dust or other foreign materials do not accumulate on the runner portion thereof and this ensures smooth movement of the original carriage 2. Also, when the original carriage 2 is in its predetermined position, the entire guide rail 70 underlies the carriage 2 and this is effective in respect of safety as well as dust-proof.

A sequence control circuit will now be discussed.

Reset Circuit

Figure 14A:
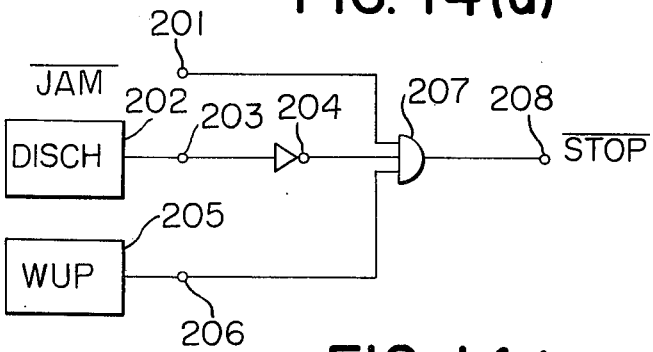
FIG. 14*a* diagrammatically shows a reset command generating circuit.
Figure 14B:
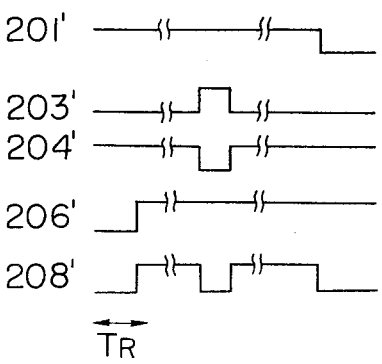
FIG. 14-b is a time chart therefor.

The circuit shown in FIG. **14*a* serves to generate a signal for instructing the copying apparatus to stop its copying operation and the entire circuit to reset when the main switch is closed (hereinafter represented as STOP), and FIG. 14-*b* is the time chart therefor. In FIG. 14-*a*, an inverted signal $\overline{JAM}$ for a signal put out from a transfer paper jam detecting circuit, to be described, during ocurrence of jam (hereinafter represented as JAM) is applied from terminal 201 to one of three-input AND gate 207. Herein, it should be noted that the signal "$\overline{XYZ}$" means that when a phenomenon meant by it occurs, the signal is a high level signal or a signal of the level which is regarded as logic "1" and that when no such phenomenon occurs, the signal is a low level signal or a signal of the level which is regarded as logic "0", and these respective levels will hereinafter be represented simply as 1 and 0. The inverted signal is a signal assuming the entirely opposite level, and represented as $\overline{XYZ}$. A circuit 202 puts out 1 when a spark discharge takes place in the charger, and the signal generated thereby will hereinafter be represented as DISCH, although the details of this circuit are not described herein. The DISCH is put out from terminal 203 and inverted through inverter 204 and applied to another input terminal of the gate 207. A further circuit 205 generates, upon closing of the main switch, a signal for resetting a necessary portion of other digital circuit to its initial condition before the starting, and this circuit puts out 0 for a predetermined time TR from the closing of the main switch and puts out 1 after lapse of predetermined time, but the details thereof need not be described. Such output will hereinafter be represented as WUP. The WUP is applied from terminal 206 to the other input terminal of the gate 207. Thus, if, as shown in FIG. 14**-*b*, the input signals from the terminals 201, 203 and 206 are designated by 201', 203' and 206' and the output of the inverter, i.e. the inverted signal for 203' is designated by 204', then the output of the gate 207 will be 0, as indicated by 208' when one or more of 202', 204' and 206' are 0, namely, when JAM is 1 or DISCH is 1 or WUP is 0, and will be put out as STOP from terminal 208 to reset the then necessary other circuit. The reason why the inverted signal for STOP is put out as the reset signal is that being 0 is very convenient to effect reset in the subsequent circuit.

Introductory Rotation Circuit

Figure 15:
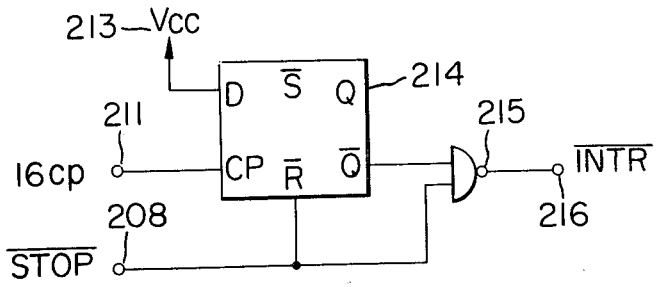
FIG. 15-a diagrammatically shows an introductory rotation signal generating circuit.
Figure 15:
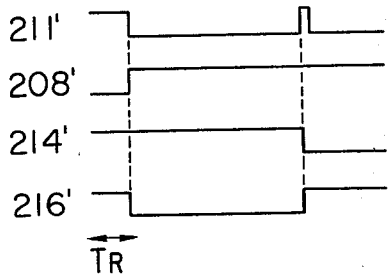

FIG. 15-10a shows a circuit which generates a signal for effecting the introductory rotation upon closing of the main switch (hereinafter represented as INTRO). A D-type edge triggered flip-flop 214 will first be considered. This flip-flop, when a rising pulse waveform shifting from 0 to 1 is applied to input terminal thereof, puts out from its output terminal Q a signal identical with the digital signal being then applied to the input terminal D, and maintains such output condition until a rising signal is again applied to terminal CP, but when 0 is applied to input terminal $\overline{S}$ or to input terminal $\overline{R}$, the output Q will be and maintain 1 or 0, respectively, independently of the then conditions of the input terminals CP and D. The output terminal $\overline{Q}$ is for putting out an inverted signal for Q output. The flip-flop having such function will hereinafter be represented as FF. In FF214, a source voltage $V_{cc}$ 213 is first applied to the terminal D thereof. $V_{cc}$, as the digital signal in the circuit, is at the level which is regarded as 1. The terminal $\overline{R}$, STOP is applied from terminal 208. Thus, 0 is applied to terminal $\overline{R}$ for the time TR from the closing of the main switch so that 1 is put out from terminal $\overline{Q}$ and such condition is maintained. Signal 16CP indicating the drum having made substantially one complete rotation is generated from a clock pulse counter circuit and applied from terinal 211 to terminal CP and, when the 16CP has risen, terminal $\overline{Q}$ assumes 0. The output of the terminal $\overline{Q}$ is further applied to one of the input terminals of two-input NAND gate 215 and $\overline{STOP}$ is applied to the other input terminal of this gate. Thus, the output of the gate 215, as indicated at 216' in the time chart of FIG. 15-b, continues for the time 0 which is the time 1 minus the time TR from the closing of the main switch, and an output for effecting the introductory rotation for such time 0 is put out from terminal 216 as the inverted signal $\overline{INTR}$. The reason why the output is provided in the form of inverted signal is that it is very convenient to the subsequent circuit. Also, in FIG. 15-*b*, numerals 211' and 208' denote signals applied from terminals 211 and 208, respectively.

Count Means

Figure 16:
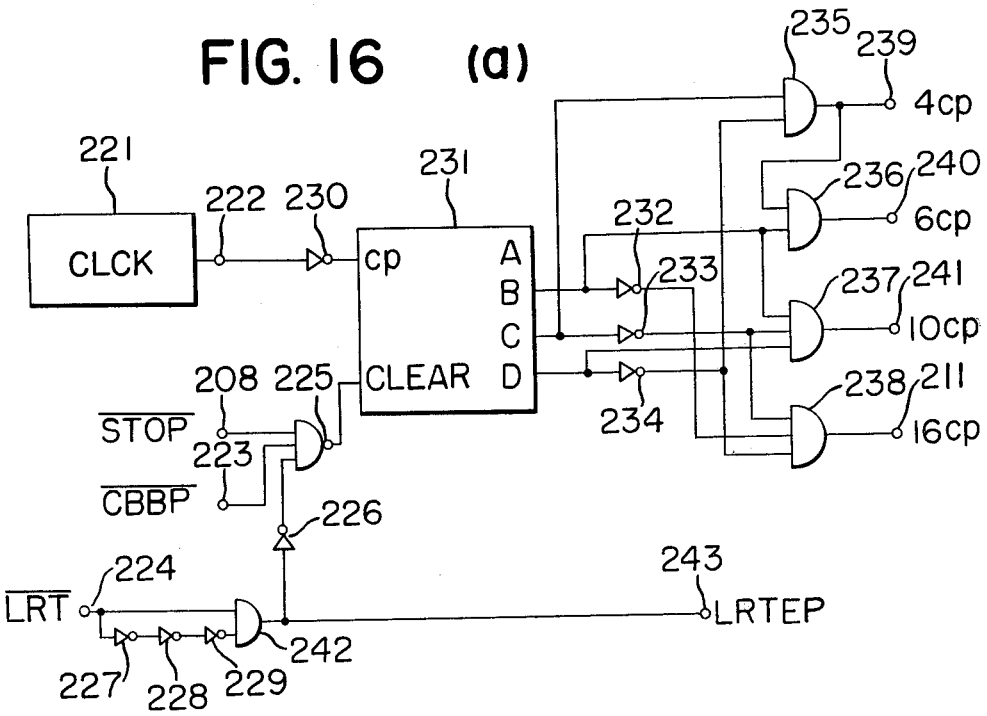
FIG. 16-a diagrammatically shows a clock pulse counter circuit.
Figure 16:
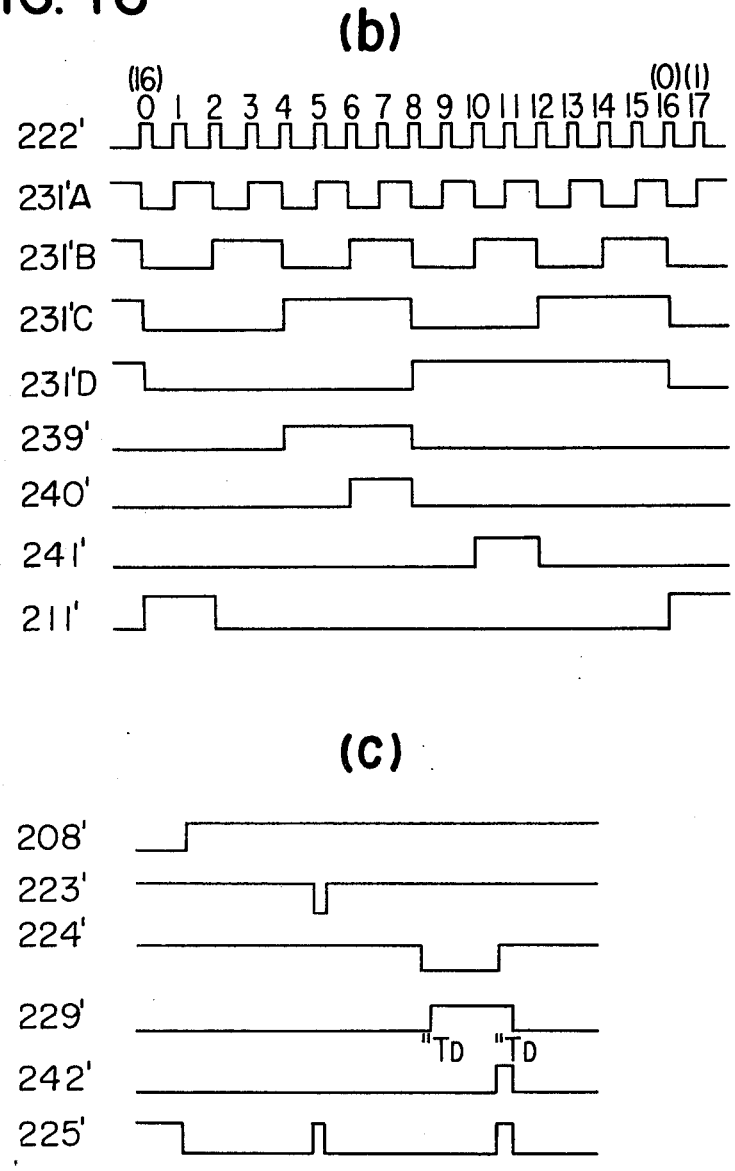

A clock pulse counter circuit will now be described by reference to FIG. 16-*a* and time charts of FIGS. 16-*b* and 16-*c*. Designated by 221 is a clock pulse generator which detects periodic variation in the field intensity by means of a magneto-sensitive element and generates a pulse corresponding to the output of that element and converts it into a clock pulse. More specifically, in the present embodiment, a magnet (143 in FIG. 4) is moved in synchronism with the rotation of the photosensitive drum (15 in FIG. 1) so as to pass by a magneto-sensitive element (164 in FIG. 4) fixed at a specific position and utilizing the Hall effect, whereby an output shaped like a pulse is generated as the output of the magneto-sensitive element. Designated by 231 is a binary counter which is triggered when signals falling from 1 to 0 are successively applied as clock pulse to the input terminal CP thereof, thereby generating at the output terminal A an output which is the clock pulse frequency-divided into $\frac{1}{2}$, at the output terminal B an output which is the clock pulse frequency-divided into $\frac{1}{4}$, at the output terminal C an output which is the clock pulse frequency-divided into $\frac{1}{8}$, and at the output terminal D an output which is the clock pulse frequency-divided into 1/16. These outputs are in the forms as shown by 231'A, 231'B, 231'C and 231'D, in FIG. 16-b. In FIG. 16-b, however, 222' is a signal entering from the output terminal 222 of the clock pulse generator 211 in FIG. 16-a, and this signal is applied through inverter 230 to the terminal CP of counter 231 and thus, the rising portion of the signal 222' provides the trigger point. The clock pulse signal at the terminal 222 will hereinafter represented as CLCK. When 1 is applied to the input terminal CLEAR of the counter 231, the output terminals A, B, C and D will all assume 0 and as will be seen in FIG. 16-*b*, the condition at this time is entirely the same as that when the 0th or the 16th clock pulse is applied. Unless 1 is applied to the terminal CLEAR, the output reiterates the condition of the 0th to the 15th clock pulse and in the following description, the condition when 1 is applied to the terminal CLEAR and the condition when the clock pulse corresponding to the 0th or the 16th will all be referred to as the condition when the 16th clock pulse is applied. In FIG. 16-*a*, the following three types of reset signals are applied to the terminal CLEAR of the counter 231 in order to operate the other circuits effectively. First, $\overline{STOP}$ as the reset signal during closing of the main switch is applied from terminal 208 to one of the input terminals of three-input NAND gate 225, and inverted signal $\overline{CBBP}$ for signal CBBP (to be further described) which represents the arrival of the original carriage (2 in FIG. 1) at the reverting position is applied to another input terminal of the gate 225. A pulse signal representing the completion of the last rotation is applied to the other input terminal of the gate 225 and this signal may be generated in the following manner. Inverted signal $\overline{LRT}$ for a signal LRT (to be further described) representing the drum being in the last rotation is first applied from terminal 224 directly to one of the input terminals of two-input AND gate 242, and further through inverters 227, 228 and 229 to the other input terminal. At this time, as shown in FIG. 16-*c*, the signal 224' at the terminal 224 and the output signal 229' of the inverter are in inverted relationship with each other, but the signal 229' which goes through the three inverters is delayed with respect to the signal 224'. Let this delay time be TD. The output signal 242' of the gate 242 equal the TD time 1 ranging from the rising time of LRT, i.e. the rising time of the signal 224', till the falling time of the signal 229', as shown. This signal representing the completion of the last rotation (hereinafter represented as LRTEP) is put out from terminal 243 to other circuit and also applied through inverter 226 to gate 225. This, this signal provides a reset signal. The output signal 225' of the gate 225, as shown, is put out as 1 to reset (clear) the counter 231 when one of STOP, CBBP and LRTEP becomes 1. Next, the outputs of the counter 231 may be combined in the following manner. Terminal C output and inverted terminal D output through inverter 234 are applied to the input terminals of two-input AND gate 235; gate 235 output and terminal B output are applied to the input terminals of two-input AND gate 236; terminal B output, inverted terminal C output through inverter 233 and terminal D output are applied to the input terminals of three-input AND gate 237; and inverted terminal B, C, D outputs through inverters 232, 233, 234 are applied to the input terminals of three-input AND gate 238. Thus, the outputs of the respective AND gates are such as shown in FIG. **16-*b*, wherein the output 239' of the gate 235 ranges over the period 1 of the 4th to 7th clock pulse, the output 240' of the gate 236 ranges over the period 1 of the 6th to 7th clock pulse, the output 241' of the gate 237 ranges over the period 1 of the 10th to 11th clock pulse, and the output 211' of the gate 238 ranges over the period 1 of the 16th (0th) to 1st clock pulse. These outputs are put out as 4CP, 6CP, 10CP and 16CP signals from terminals 239, 240, 241 and 211**, respectively. The above-described clock pulses are generated at the rate of 15.75 per complete rotation of the drum, in the present embodiment. This means that, in the 16-bit count system previously described, sixteen clock pulses when counted indicates effectively that the drum has made substantially one complete rotation.

Copy Size Circuit

Figure 17:
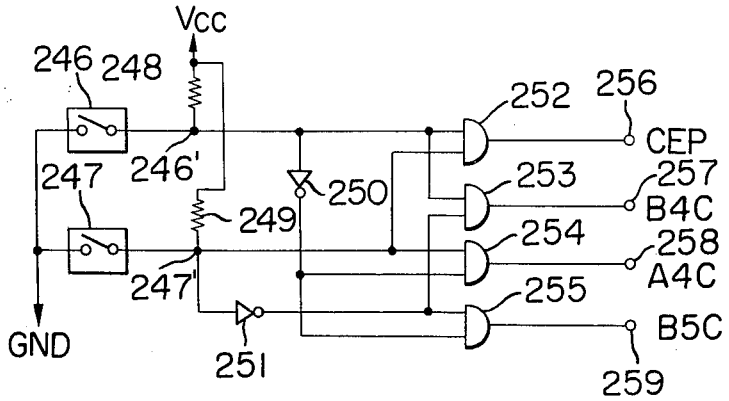
FIG. 17 diagrammatically shows a copy size signal generating circuit.

A copy size signal generator circuit will now be described by reference to FIG. 17. In the present embodiment, as already described, an endless photosensitive drum is employed and control is effected in accordance with each copy size, in order to enhance the time efficiency of the copying process. Each copy size is automatically recognized as soon as a transfer paper cassette is inserted into the apparatus body. More specifically, discrimination between four modes, namely, the mode of "no cassette", the mode of "B4 size cassette", the mode of "A4 size cassette" and the mode of "B5 size cassette", is performed by the circuit as shown in FIG. 17. In FIG. 17, microswitches 246 and 247 are both in open position (when there is no cassette inserted) and output terminals 246' and 247' are connected to the source voltage $V_{cc}$ through resistors 248 and 249, respectively, so that the circuit is in signal 1 condition. However, if the microswitches 246 and 247 are changed over into ON position by insertion of a cassette, the output terminals 246' and 247' will be connected to zero potential portion GND (ground) to bring about signal 0 condition. In the present embodiment, if a B4 size cassette is inserted, the microswitch 247 will be changed over into ON position; if a A4 size cassette is inserted, the microswitch 246 will be changed over into ON position; and if a B5 size cassette is inserted, both microswitches 246 and 247 will be changed over into ON position. The signals of the output termonals 246' and 247' are applied to the input terminals of two-input AND gate 252; the signal of the output terminal 247' and the signal of the output terminal 246' passed through inverter 251 are applied to the input terminals of two-input AND gate 253; the signal of the output terminal 246' and the signal of the output terminal 247' passed through inverter 250 are applied to two-input AND gate 254; and the signals of the output terminals 246' and 247' respectively passed through inverters 250 and 251 are applied to two-input AND gate 255. Therefore, when no cassette is inserted, the output of the gate 252 will be 1 and put out as no-cassette signal (hereinafter represented as CEP) from terminal 256; when a B4 size cassette is inserted, the output of the gate 253 will be 1 and put out as B4 size copy signal (hereinafter represented as B4C) from terminal 257; likewise, the output of the gate 254 and the output of the gate 255 will respectively be put out as A4 size copy signal (hereinafter represented as A4C) and B5 size copy signal (hereinafter represented as B5C) from terminals 258 and 259.

Copy Command Signal Circuit

Figure 18:
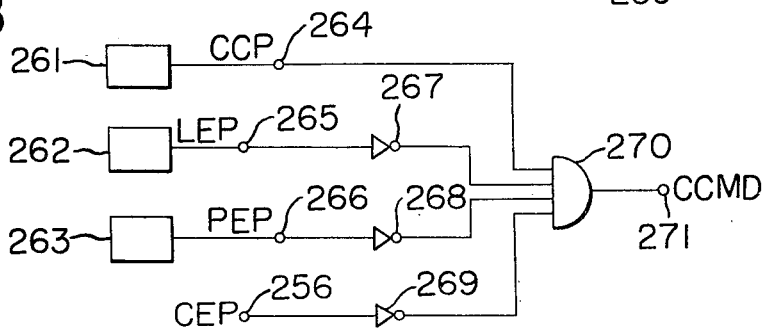
FIG. 18 diagrammatically shows a copy execution command signal generating circuit.

A circuit for generating copy command signal (hereinafter represented as CCMD) is shown in FIG. 18. Designated by 261 is a circuit which, like the circuit 221 in FIG. **16-*a*, uses a magnet and a Hall element and utilizes the Hall effect to detect any variation in the field intensity resulting from movement of the magnet caused by depression of the copy button (13 in FIG. 2), thereby generating an output 1. This output is applied as CCP from terminal 264 to one of four-input of AND gate 270. Designated by 262 is a circuit for outputting 1 as LEP when the developing liquid in the developing device (24 in FIG. 1) is decreased, and in the present embodiment, the circuit 262 employs a pair of magnet and Hall element as does the circuit 261. The output LEP is applied from terminal 265 through inverter 267 to another input terminal of the gate 270. Designated by 263 is a circuit for outputting 1 as REP when the paper in the cassette is exhausted and in the present embodiment, it employs a lamp and a CdS element opposed to each other between which paper is interposed so that presence thereof may be detected. When the paper is exhausted, the output 1 of this circuit is applied as PEP from terminal 266 through inverter 268 to still another input terminal of the gate 270. Another CEP, generated by the circuit of FIG. 17 and put out from terminal 256, is applied through inverter 269 to a further input terminal of the gate 270. Thus, the output of the gate 270 is such that CCP is 1 upon depression of the copy button, LEP is 0 with the developing device filled, PEP is 0 with transfer paper present in the cassette and becomes 1 when CEP is 0 with the cassette itself mounted, and these are put out as CCMD from terminal 271**.

Copy Execute Signal Circuit

Figure 19:
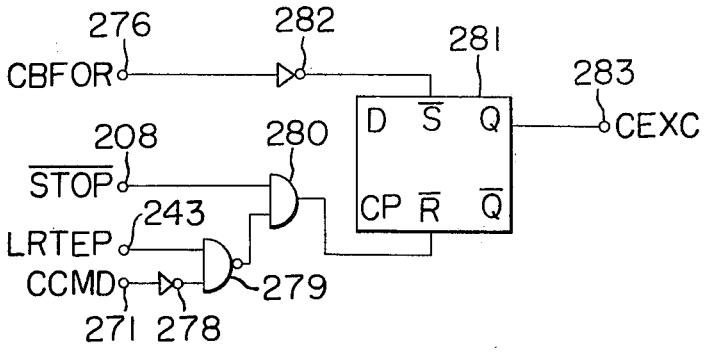
FIG. 19 is a diagram of a copy execution signal generating circuit.

FIG. 19 shows a circuit for generating a signal CEXC indicating that copying operation is being executed (hereinafter simply represented as CEXC). Signal CEXC is the signal which provides the time 1 from when the original carriage has started its forward movement for a first sheet of copy after closing of the main switch of the copying apparatus until the last rotation of the drum to an end after the last sheet of copy has been completed, as will further be described, an original carriage forward command signal CBFOR is first applied from terminal 276 through inverter 282 to terminal $\overline{S}$ of FF281. As a result, the FF281, which has in advance been reset by 0 $\overline{STOP}$ signal upon closing of the main switch, as will further be described, produces an output 1 at terminal Q when the first carriage forward command signal CBFOR has become 1, and this output is put out as CEXC from terminal 283. Also, the $\overline{STOP}$ signal, in which the reset signal during the closing of the main switch is included, is applied from terminal 208 to one of the input terminals of two-input AND gate 280 and therefore, when $\overline{STOP}$ becomes 0, the output of the gate 280 also becomes 0 and this output is further applied to terminal $\overline{R}$ of FF281, so that the Q output thereof becomes 0. The reset of FF281 may also be accomplished by LRTEP signal of 1 applied thereto from terminal 243. The LRTEP, as described in connection with FIGS. 16-a and 16-c, is a signal which becomes 1 only for a time TD at the end of the last rotation, and it is applied from terminal 208 to one of the input terminals of two-input NAND gate 279. Since signal CCMD is applied from terminal 271 through inverter 278 to the other input terminal of the gate 279, LRTEP is inverted and applied to the gate 280 only when CCMD is 0, and this is meant to prevent CEXC from being reset even if the copy button is depressed during the last rotation of the drum so that CCMD becomes 1 and LRT rises then.

In the present embodiment, as already described, the sequence of rotation of the photosensitive drum (hereinafter simply referred to as drum) is programmed to enhance the efficiency of the copying process.

The present copying machine is such that after each circuit has been reset by WUP signal upon closing of the main switch, the drum makes one complete rotation as introductory rotation and if the copy button is not depressed then, the drum stops rotating and assumes its rest condition. If the copy button is depressed with the drum in such rest condition and CCMD becomes 1, the original carriage starts its forward movement after lapse of the time corresponding to four clock pulses so that the area of the drum which might have been engaged by the cleaning blade (34 in FIG. 1) during the stoppage of the drum may be avoided for copying and that the time delay with which the fluorescent lamp is turned on may be waited for, and during the formation of the latent image to be transferred to the first sheet of copy paper, the drum is subjected to exposure just before charged by the primary charger (21 in FIG. 1), thereby correcting the difference in condition of the photosensitive layer of the drum during continuous copying. However, such exposure (hereinafter referred to as pre-exposure) is effected darkly also for the second and subsequent copy sheets.

Bright Lighting Circuit

Figure 20:
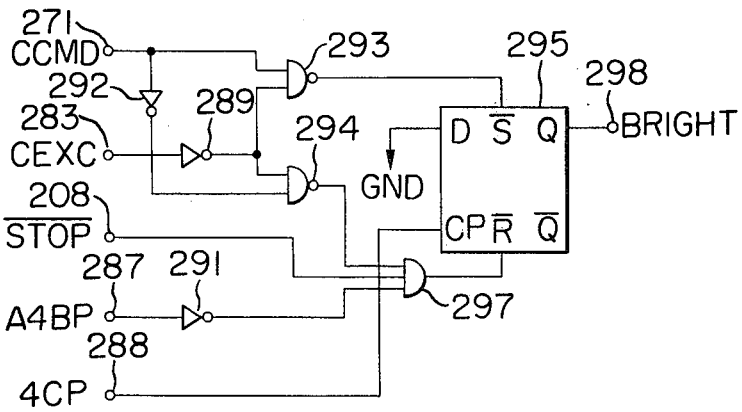
FIG. 20 diagrammatically shows a pre-exposure intensity increase command signal generating circuit.

FIG. 20 shows a circuit which generates a BRIGHT signal for turning on the exposure lamp with a high intensity of illumination during the first sheet copy. As described in connection with the CEXC generating circuit (FIG. 19), the state in which CCMD is 1 and CEXC is 0 occurs only immediately before the first sheet copy is executed. Signal CCMD is applied from terminal 271 to one of the input terminal of two-input NAND gate 293, and signal CEXC is applied from terminal 283 through inverter 289 to the other input terminal of the gate 293. Thus, when the CEXC is 0 and the CCMD is 1, the output of the gate 293 is 0 and this is applied to terminal $\overline{S}$ of FF295, the Q output of which is thus 1 and put out as BRIGHT signal from terminal 298. The intensity of the pre-exposure which has been increased with the BRIGHT signal being 1 must be decreased back to a low intensity after the drum has been substantially one complete rotation. Therefore, in the case of A4 size or B4 size copy, FF295 is reset when the signal A4BP (to be further described) representing the arrival of the originl carriage at its reverting position for A4 size has become 1, and in the case of B5 size copy, FF295 is reset after the counter 231 of FIG. 16-a is reset upon arrival of the original carriage at its reverting position for B5 size and thereafter, when the signal 4CP which rises upon entry of the fourth clock pulse has been given out, whereby the illumination of high intensity for the pre-exposure is stopped. In the circuit, signal A4BP is first applied from terminal 287 to terminal $\overline{R}$ of FF295 through inverter 291 and three-input AND gate 217. Thus, when A4BP becomes 1, 0 is applied to the terminal $\overline{R}$ to thereby reset FF295, the Q output of which thus becomes 0. If A4BP does not become 1 and when the signal 4CP is applied from terminal 288 to terminal CP of FF295, the Q output of FF295 becomes 0. As further signals for resetting the FF295, there are STOP, CEXC which is inverted through inverter 289 and applied from terminal 283 to one input terminal of two-input NAND gate 294, and CCMD which is applied from terminal 271 through inverter 292 to the other input terminal of the gate 294. The output of the gate 294 is in turn applied through gate 297 to terminal $\overline{R}$ of FF295. The STOP as the reset signal during the closing of the main switch is intended to reset FF295, and even if 4CP and CBFOR have risen after FF295 has been set (the output Q has been set to 1) with CCMD being 1 and CEXC being 0, the original carriage will not move to effect copying if CCMD has become 0 before CEXC rises and therefore, the output of the gate 294 is meant to reset FF295 in such case so that the pre-exposure may restore its weak intensity. Hereat, signal 4CP is applied to terminal CP to reset FF295 during B5 size copy, but even if signal 4CP has risen after CCMD has become 1, CEXC remains to be 0 immediately after the rising of 4CP because CEXC rises with the rising of the original carriage forward command signal CBFOR, and thus FF295 is not reset by the rising of 4CP.

Last Rotation Circuit

Figure 21:
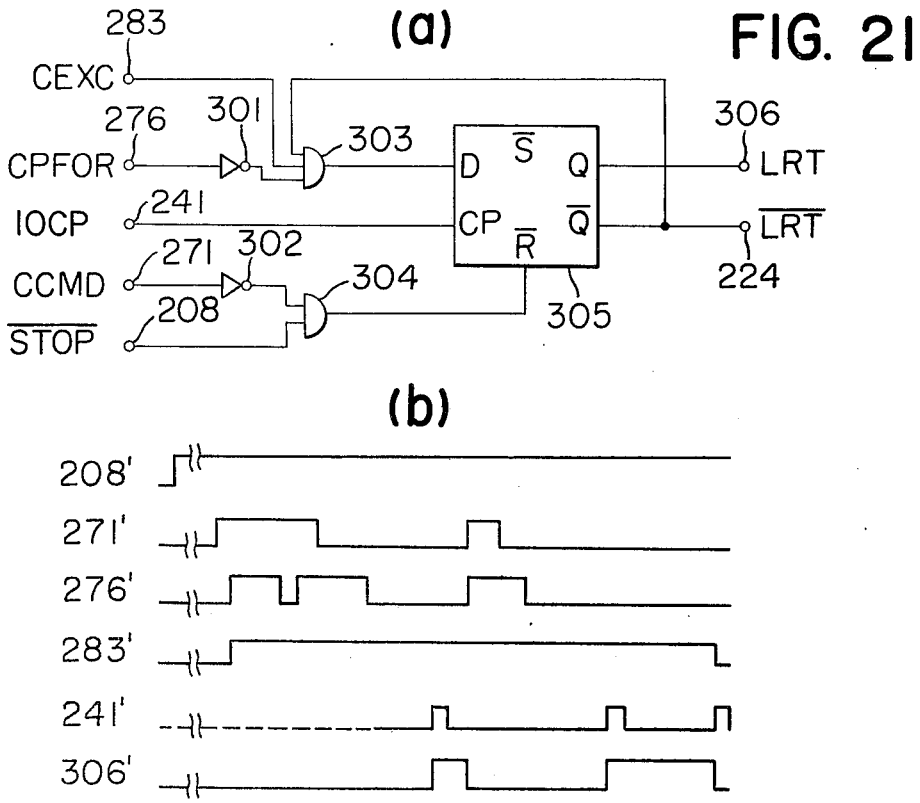
FIG. 21-a is a diagram of a last rotation command signal generating circuit.

A circuit for generating a last rotation command signal LRT will be described with reference to FIG. 21-a and the time chart of FIG. 21-b. In the present embodiment, the last rotation occurs after the latent image formed and developed on the drum in the last sheet copy cycle and has been transferred to transfer paper, and it is terminated after the drum has made substantially one complete rotation. First, FF305 is reset during closing of the main switch by signal $\overline{STOP}$ applied from terminal 208 to terminal $\overline{R}$ through two-input AND gate 304, and the Q and $\overline{Q}$ outputs thereof become O and 1, respectively. Next, signal 10CP is applied from terminal 241 to terminal CP of FF305 and this signal becomes 1 during the introductory rotation of the drum, during the forward movement of the original carriage, and at a point of time whereat the image transfer is terminated after the counter 231 of FIG. 16-a has been reset with the arrival of the original carriage at its reverting position. CEXC is applied from terminal 283 to one input terminal of three-input AND gate 303, inverted CBFOR signal is applied from terminal 276 through inverter 301 to another input terminal of the gate 303, and the output $\overline{Q}$ of FF305 is applied to still another input terminal of the gate 303, the output of which is in turn applied to the terminal D of FF305 to thereby set FF305 and thus, the Q output becomes 1 only when CEXC is 1 and CBFOR is 0 and LRT is 0.

FF305 thus becomes ready to be set by 10CP generated at the end of image transfer. However, since inverted CCMD is applied from terminal 271 through gate 304 to terminal $\overline{R}$ of FF305, FF305 is actually set when CCMD has become 0 as soon as the button is released, namely, when the last sheet copy is being carried out. This in turn interrupts the last rotation at a point of time when CCMD becomes 1 by the copy button being depressed while the last rotation is being executed with FF305 set and with LRT being 1. Also, the signal 10CP, after having risen to 1, again rises when sixteen clock pulses have all been generated, as already described in connection with FIG. 16-a. In the meantime, therefore, the drum makes substantially one complete rotation and since the output $\overline{Q}$ of FF305 being then applied to the gate 303 has already become 0 and the terminal D has also become 0, the output Q of FF305 is reset to 0 to terminate the last rotation. The outputs Q and $\overline{Q}$ of FF305 are put out as LRT and $\overline{LRT}$ from terminals 306 and 224 to another circuits, respectively. FIGS. 21-b is the time chart for the circuit of FIG. 21-a. Designated by 208', 271', 276', 283', 241' and 306' are signal waveforms at terminals 208, 271, 276, 283, 241 and 306, respectively. After continuous two-sheet copying, signal 10CP rises and LRT rises, and the chart exemplarily shows the case in which one more sheet copy is effected after the last rotation.

Original Carriage Moving Circuit

Figure 22:
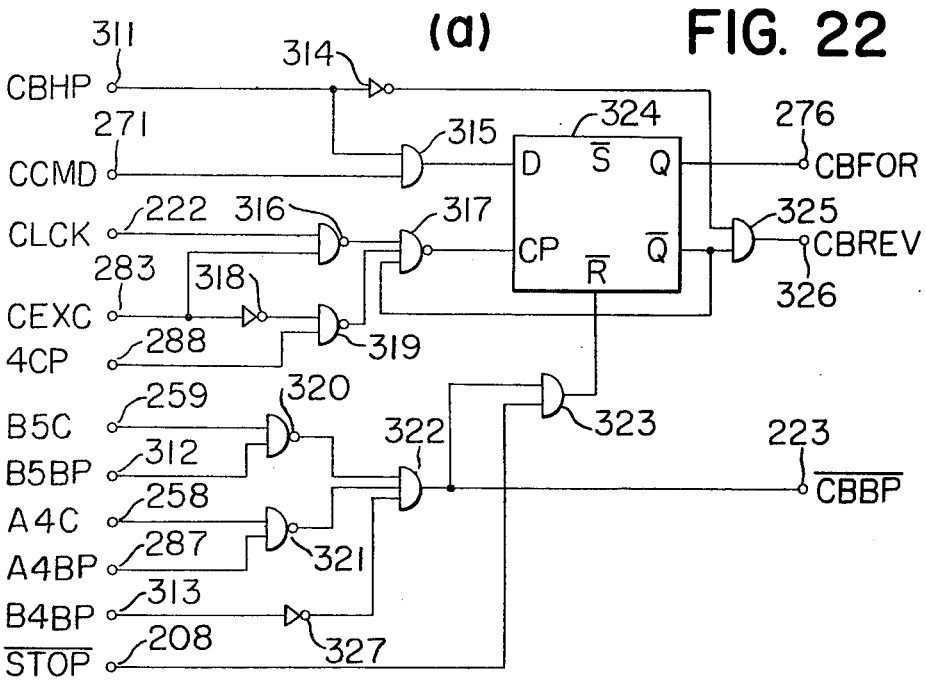
FIG. 22-a diagrammatically shows an original carriage forward-backward command signal generated circuit.
Figure 22:
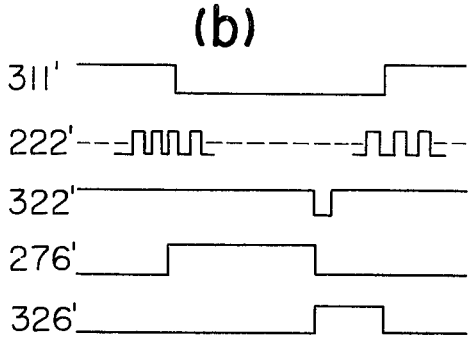

A circuit for generating original carriage forward-backward command signals will now be described with reference to FIG. 22. The sequence of movement of the original carriage will first be explained. Introductory rotation of the drum takes place after closing of the main switch, and after termination of the introductory rotation (at this time, CEXC still remains to be 0), CCMD becomes 1, whereupon the original carriage waits for a time corresponding four clock pulses and then starts its forward movement and reaches its reverting position for B5, A4 or B4, from which position the carriage begins to more backwardly to its home position (start position). In the present embodiment, however, the original carriage cannot start when it is not in its home position, but it can automatically move to the home position when the main switch is closed.

In present embodiment, the detector device for detecting these positions of the original carriage comprises, like the clock pulse generator shown in FIG. 16-a, a pair of magnet and Hall element. More particularly, a magnet is attached to the original carriage and a Hall element secured to the apparatus body detects a variation in field intensity caused by movement of the magnet, thereby generating signals indicating the arrival of the original carriage at its home position and the arrival of the carriage at its reverting position for B5, A4 or B4 copy size. In the circuit shown in FIG. 22, signal CBHP indicative of the original carriage being at its home position (hereinafter represented as CBHP) is applied from terminal 311 to one input terminal of two-input AND gate 315, and CCMD is applied from terminal 271 to the other input terminal of the gate 315. Therefore, if CCMD becomes 1 when the original carriage is at its home position, the output of the gate 315 will become 1 and be applied to terminal D of FF324.

Also, signal CLCK is applied from terminal 222 to the other input terminal of two-input NAND gate 316 and CEXC is applied from terminal 283 to the other input terminal of the gate 316, so that inverted CLCK signal is put out from the gate 316 when the CEXC is 1. Further, signal 4CP is applied from terminal 288 to one input terminal of two input NAND gate 319 and CEXC is applied to the other input terminal of this gate through inverter 318, so that inverted 4CP signal is put out from the gate 319 when the CEXC is 0. The outputs of these gates 316 and 319 are further applied to two input terminals of three-input NAND gate 317, and the $\overline{Q}$ output of FF324 is also applied to the other input terminal of the gate 317. Thus, when the $\overline{Q}$ output of FF324 is 1, signal CLCK or 4CP is put out from the gate 317 through the gate 316 or 319, respectively, and applied to the terminal CP of FF324. Therefore, if CCMD is 1 during a first sheet copy, namely, when CEXC is 0, FF324 is set by the rising of signal 4CP and the output Q will become 1 and be put out as original carriage forward command CBFOR (hereinafter simply represented as CBFOR) from terminal 276. During a second and subsequent sheet copy, CEXC has already become 1 and the original carriage is back to its home position and, when CBHP becomes 1, CBFOR becomes 1 by the rising of CCLK signal subsequently entered, whereby the original carriage moves forwardly. Next, the reversal of the original carriage is effected by the output of three-input AND gate being applied through two-input AND gate 323 to the terminal $\overline{R}$ of FF324. In the case of B5 size copy, signal B5C as 1 is applied from terminal 259 to one input terminal of two-input NAND gate 320 and B5BP is applied from terminal 312 to the other input terminal of the gate 320. Thus, when B5BP has become 1, it is inverted through the gates 320, 322 and 323 and applied to terminal $\overline{R}$ of FF324 to reset the FF324. Likewise, in the case of A4 size copy, signals A4C and A4BP are applied from terminals 258 and 287 to the input terminals of two-input NAND gate 321, the output of which is in turn applied to one of the input terminals of the gate 322. In the case of B4 size, B4BP is inverted through inverter 327 and applied to another input terminal of the gate 322. Thus, the respective original carriage reverse signals are inverted through the gates 322 and 323 and applied to terminal $\overline{R}$ of FF324, whereupon the output $\overline{Q}$ becomes 1 and is put out as original carriage backward command signal CBREV (hereinafter simply represented as CBREV) from terminal 326 through two-input AND gate 325 to other circuit. However, when CBHP at the gate 325 becomes 1 with the original carriage coming back to its home position, 0 is applied through inverter 314 to one input terminal so that CBREV becomes 0 to stop the backward movement of the carriage. As in other circuit, $\overline{STOP}$ is also applied from terminal 208 through gate 323 to terminal $\overline{R}$ of FF324. The output of the gate 322 is put out as $\overline{CBBP}$ from terminal 223 also to other circuit. FIG. 22-b is a time chart for the case where CCMD and CEXC are 1 in the circuit of FIG. 22-a. Those signal waveforms indicated at 311', 222', 322', 276' and 326' correspond to CBHP, CLCK, $\overline{CBBP}$, CBFOR and CBREV, respectively.

Paper Feed Circuit

Figure 23:
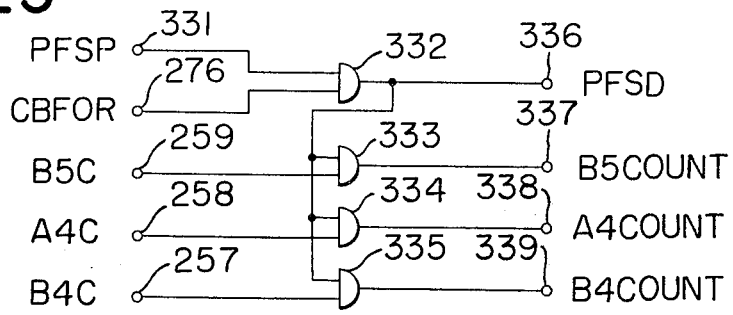
FIG. 23 diagrammatically shows a paper feed start command signal generating circuit.

FIG. 23 shows a circuit for generating paper feed start command signal PFSP. In the figure, a signal indicating the arrival of the original carriage at a specific position is generated from terminal 331 by the use of means entirely identical with the original carriage reverting position detector means shown in FIG. 22-a, and this signal is applied as paper feed timing signal PFSP to one of the input terminals of two-input AND gate 332. To the other input terminal of the gate 332, CBFOR is applied from terminal 275 so that, when PFSP is applied as 1 during forward movement of the original carriage, the output of the gate 332 becomes 1 and is put out as PFSD from terminal 336. Also, in the present embodiment, count of the number of copies is accomplished by applying the aforesaid PFSD signal and each copy size signal to the input terminals of two-input AND circuit and by using the output of such AND circuit. More specifically, in FIG. 23, B5C, A4C or B4C is applied from terminal 259, 258 or 257 to one input terminal of two-input AND gate 333, 334 or 335, whereupon each gate puts out a signal B5COUNT, A4COUNT or B4COUNT from terminal 337, 338 or 339.

Jam Detector Circuit

Figure 24:
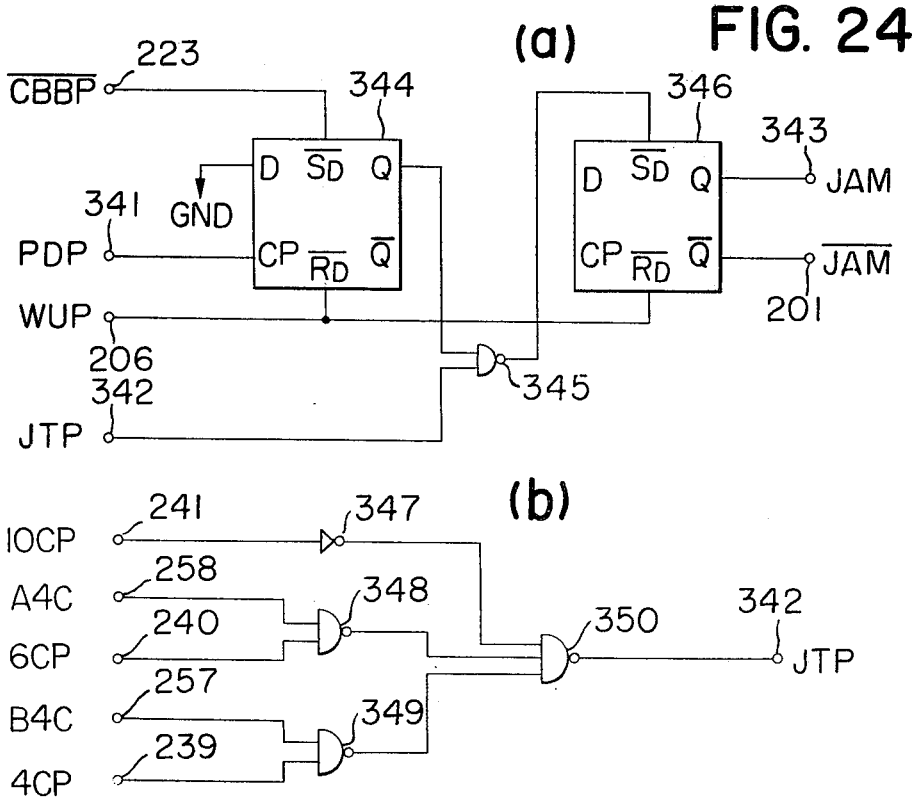
FIG. 24-a is a diagram of a jam detecting circuit.
Figure 24:
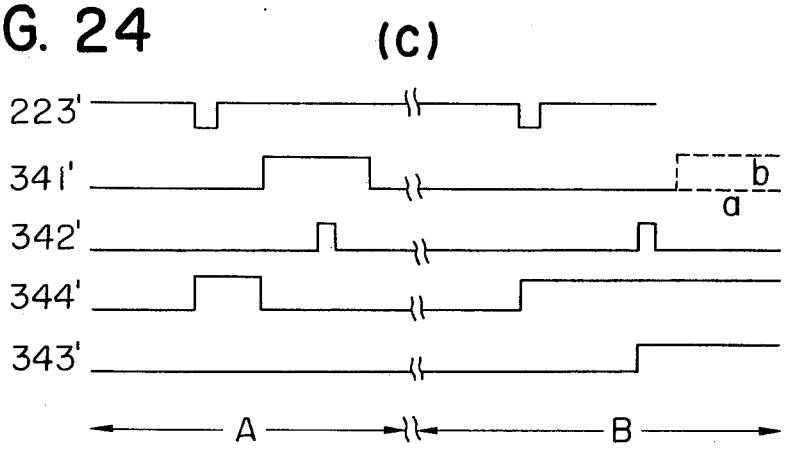

A circuit for detecting occurrence of abnormal transport of transfer paper during copying process, such as extreme delay of the paper, stagnation of the paper in the transport passage, etc. (hereinafter simply referred to as jam) will now be discussed by reference to the circuit diagrams and time chart shown in FIGS. 24-a, b and c. First, in FIG. 24-a, the CBBP, the generation of which has already been described in connection with FIG. 22-a, is applied as set signal from terminal 223 to terminal $\overline{SD}$ of FF344. Thus, when $\overline{CBBP}$ becomes 0, the output Q of FF344 becomes 1 and this signal is in turn applied to one of the input terminals of two-input NAND gate 345. To the other input terminal of the gate 345, jam timing signal JTP (hereinafter simply represented as JTP) is applied from terminal 342. The JTP is a pulse signal which is generated after lapse of some allowance time from the time when the leading edge of the transfer paper subjected to the image transfer and drying-fixing steps reaches a specific position in a predetermined path by a normal transport step. If JTP becomes 1 when the output Q of FF344 is 1, the output of the gate 345 will become 0 and be applied to terminal $\overline{SD}$ of FF346 to set the latter. Thus, the output Q of FF346 becomes 1 and is put out as jam occurrence signal JAM from terminal 343. Inverted JAM signal, $\overline{JAM}$, is put out from the output $\overline{Q}$ of FF346, namely, from terminal 201, to other circuit. When the transfer paper is transported normally, signal PDP from a paper detector at said specific position is applied from terminal 341 to terminal CP of FF344 and terminal D is connected to GND (ground) and has become 0, so that the output Q of FF344 is caused to be 0 by the rising of signal PDP from 0 to 1 and thus, even if JTP becomes 1 at the gate 345, the output thereof will not become 0 and FF346 will not be set. In the time chart of FIG. 24-c, the portion A designates the signal waveform during normal transport and the portion B denotes the signal waveform during occurrence of jam. Designated by 223', 341', 342', 344' and 343' are the signal waveforms of $\overline{CBBP}$, PDP, JTP, Q output of FF344 and Q output of FF346 (JAM), respectively. Broken-line portions a and b of signal 341' indicate non-arrival or extremely delayed arrival of transfer paper at the specific position. In the present embodiment, the paper detector means at the specific position, like that described in connection with the PEP signal generator circuit of FIG. 18, comprises a pair of lamp and CdS element. Next, in the present embodiment, the circuit as shown in FIG. 24-b is used as the previously described JTP generating circuit. According to the present embodiment, as seen in FIG. 16-a, it is about one second before the generation of 10CP, 6CP or 4CP, in the case of B5, A4 or B4 size, that clock pulse counter 231 is reset at the original carriage reverting position and thereafter the leading edge of transfer paper arrives at the specific position by normal transport, and these respective signals thus provide jam timing signals. As shown in FIG. 24-b, signal A4C is applied from terminal 258 to one of the input terminals of two-input NAND gate 348 and signal 6CP is applied from terminal 240 to the other input terminal of the gate 348. Therefore, the output of the gate 348 is such that, only in the case of A4 size copy, the signal 6CP is inverted and applied to one of the input terminals of three-input NAND gate 350. Also, in the case of B4 size copy, B4C and 4CP are applied from terminals 257 and 239 to the input terminals of two-input NAND gate 349, the output of which is in turn applied to another input terminal of the gate 350. Signal 10CP is inverted through inverter 347 and applied to still another input terminal of the gate 350. Thus, at the output of the gate 350, signals 4CP and 10CP appear in the case of B4 size copy, signals 6CP and 10CP appear in the case of A4 size copy, and signal 10CP alone appears in the case of B5 size copy, and these are put out as JTP signals from terminal 342. Alternatively, the JTP signals may be generated independently of the copy size, for example, in a predetermined time after the point of time whereat the original carriage starts its forward movement, the point of time whereat the paper feed start timing pulse is generated or the point of time whereat signal B5BP is generated.

The jam detector circuit of the present invention utilizes the rising portion of PDP signal to detect jam and may therefore adopt a simple circuit arrangement to detect not only delay of paper but also stagnation of paper in the paper detecting section, independently of the length of paper.

Output Circuit

Figure 25:
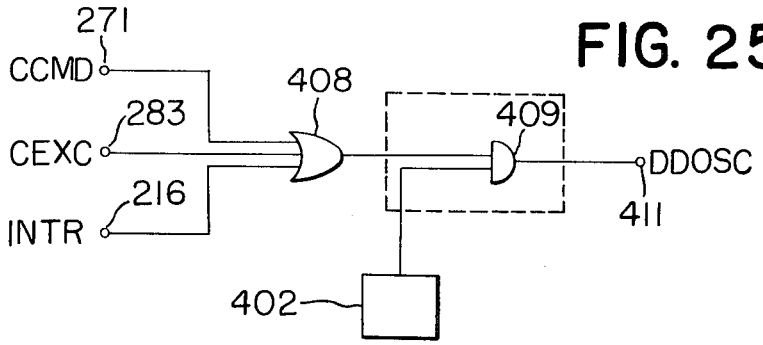
FIG. 25 diagrammatically shows a circuit for generating a signal for controlling the conduction.

In order to effect power supply to various terminal elements in accordance with the process conditions of the copying operation, the above-described control signals may be suitably combined together to control a power supply switching element, but as will further be described, the output circuit exemplarily shown in FIG. 25 is employed when the switching element used is a triac and the triac trigger circuit used is a pulse transformer. FIG. 25 shows, as an example, a circuit which generates a signal for controlling the power supply to the main motor (M1 in FIG. 5). To drive the main motor when any of CCMD, CEXC and INTR has become 1, these signals CCMD, CEXC and INTR respectively entered from terminals 271, 283 and 216 are applied to the input terminals of three-input OR gate 408 for combination, and the output of this gate 408 is in turn applied to one of the input terminals of two-input AND gate 409. To the other input terminal of the gate 409 is applied the output signal OSC from non-stable multivibrator circuit 402, whereby the output of the gate 409 provides the output from the circuit 402 only when the output of the gate 408 is 1, and such output is amplified and applied from terminal 411 to a pulse transformer in an ignition circuit for the triac which effects switching of the power supply to the main motor.

Figure 26:
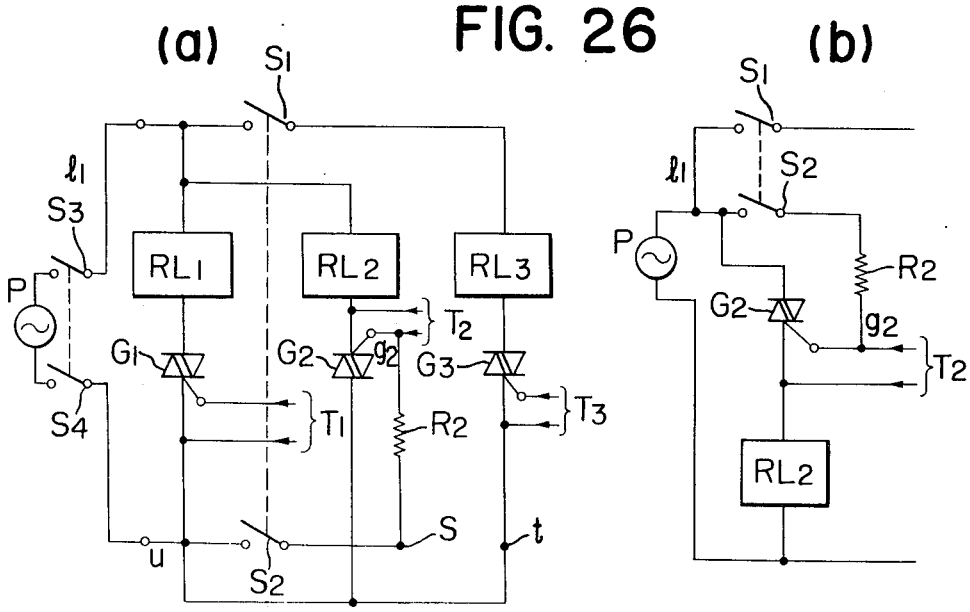
FIGS. 26-a and 26-b shows the circuits for switching the conduction to various terminal elements.

Description has hitherto been made of the digital circuit forming the main of the control circuit, including the sequence control. Now, FIG. 26 shows the circuit for switching the current flowing to various terminal elements in accordance with the output of the above-described control circuit. In FIG. 26, there is seen an AC input power source P, various terminal elements RL1, RL2 and RL3, triacs G1, G2 and G3 for switching the current flow to the terminal elements, trigger pulses T1, T2 and T3 generated by a conventional triac trigger generator circuit (not shown) in accordance with the signals from the above-described control circuit (e.g. FIG. 25). S1 and S2 denote main switches for two interlocking circuits. Thus, by generation of trigger signal T1, current may be supplied to RL1 till the end of a predetermined sequence, independently of ON-OFF of the main switches. In the present circuit example, RL1 includes a main motor, a high AC output, etc. Also, when the main switches S1 and S2 are closed, trigger voltage may be applied through the swtich S2 and resistor R2 to G2 to render G2 conductive, thus supplying current to RL2. Further, even if the main switches are opened, RL2 may be continuedly supplied with current as long as trigger signal T2 from the control circuit is generated. In the present circuit example, RL2 corresponds to the power source transformer for maintaining the control function. RL3 is deenergized when the main switches are opened even if trigger signal T3 from the control circuit is being generated, and in the present circuit example, it includes a fixing heater and so forth. The inclusion in RL2 of the power source transformer in the power source circuit for applying the source voltage to the control circuit is necessary so that the control circuit may be maintained in operable condition even if the main switches S1 and S2 are opened. The power source circuit and the trigger pulse generating circuit may be conventional ones, and those portions of other attendant circuits which are not directly concerned with the present invention may also be conventional and are herein omitted for clarity of description.

In FIG. 26-a, where it is necessary to cut off the terminal elements in RL3 from the opposite poles of the input power source, the connection at point t may be changed from point u to point s. Also, the power supply circuit for RL2 may be arranged as shown in FIG. 26-b, wherein one terminal of each of S1 and S2 is connected to one line L1 from the AC input power source P so that S1 may provide the power supply path to the terminal elements corresponding to the pair of RL3 and G3 and trigger voltage may be supplied from S2 through R2 to g2, thereby attaining the same effect as described above. described above.

The above description has been made with respect to the case where switches S3 and S4 for directly connecting and disconnecting the power source are in ON position, but these switches S3 and S4 may conveniently be used as the door switch (as shown in FIGS. 6–7) of the copying apparatus housing. In other words, when jam treatment is to be effected after detection of jam, this switch may be opened by opening the door to thereby cut off the voltage supplied to switching elements G1, G2, G3 and accordingly cut off the conduction to all loads and control circuit, thus ensuring further safety of the operation.

We claim:

1. Image forming apparatus comprising:

a rotatable medium;

means for forming an electrostatic latent image on a surface of said rotatable medium;

means for developing the latent image into a visible image;

means for transferring the visible image from said rotatable medium to a transfer material;

means for cleaning the surface of said rotatable medium for repetitive use;

driving means for rotating said rotatable medium before and during the image forming operation; and means for controlling said driving means to stop said rotatable medium at a different rotational position from its position before the start of rotation.

2. An apparatus according to claim 1, wherein said control means controls said driving means to rotate said rotatable medium a predetermined amount after a main switch of said apparatus is actuated and before beginning the image forming operation and to then stop the rotation of said rotatable medium.

3. An apparatus according to claim 2, further comprising, means for applying light to said rotatable medium during its rotation to correct its sensitivity and means for generating a signal for actuating said light applying means.

4. An apparatus according to claim 1, wherein said developing means develops the latent image with a liquid developer, and said cleaning means includes a cleaning blade, said apparatus further comprising means for beginning the image forming operation only after said rotatable medium is rotated an amount such that the initial image forming operation is not performed on a portion of said rotatable medium which was in contact with said cleaning blade before the start of rotation.

5. An apparatus according to claim 1, wherein said developing means develops the latent image with a liquid developer, and said cleaning means includes a cleaning blade, and wherein said control means additionally causes sufficient rotation of said rotatable medium to clean the entire surface of said rotatable medium with said cleaning means after the image has been transferred to the transfer material, and thereafter causing said rotatable medium to stop.

6. An apparatus according to claim 5, further comprising means for generating, in response to an image formation instruction signal during the rotation of said rotatable medium after the transfer of the image, a signal for starting a further image forming operation without completing the additional rotation thereof.

7. An apparatus according to claim 1, further comprising means for generating a series of pulse signals in accordance with the rotation of said rotatable medium, and wherein said control means performs its controlling function in response to a predetermined number of pulse signals.

8. An apparatus according to claim 7, wherein said predetermined number of pulse signals is greater than the number of pulse signals generated during one full rotation of said rotatable medium.

9. An apparatus according to claim 1, wherein said latent image forming means includes reciprocable means for the application of scanning image light to said rotatable medium, said apparatus further comprising means for generating a series of pulse signals and means for generating a signal to control movement of said reciprocable means in response to a predetermined number of said pulse signals.

10. An apparatus according to claim 1, wherein said rotatable medium has an endless photosensitive member.

11. Image forming apparatus comprising:

a rotatable medium;

means for forming an electrostatic latent image on a surface of said rotatable medium;

means for developing the latent image into a toner image;

means for transferring the toner image from said rotatable medium to a transfer material;

first signal generating means for generating a series of pulse signals in accordance with the rotation of said rotatable medium;

second signal generating means for generating a signal in response to actuation of a main switch or an image formation instruction switch of said apparatus;

means for counting the pulse signals of said first signal generating means;

means for generating control signals for starting a counting operation by said counting means in response to said second signal generating means and for controlling the image forming operation with said rotatable medium, electrostatic latent image forming means, developing means and transfer means in response to counting a predetermined number of pulse signals by said counting means.

12. An apparatus according to claim 11, wherein said latent image forming means includes reciprocable means for the application of scanning image light to said rotatable medium, and said control signal generating means further generates a signal for controlling the movement of said reciprocable means in response to a particular number of said pulse signals.

13. An apparatus according to claim 12, further comprising a cleaning blade for cleaning the surface of said rotatable medium for repetitive use of said rotatable medium, wherein said control means also generates a signal for starting movement of said reciprocable means only after said rotatable medium is rotated an amount such that the initial image forming operation is not performed on a portion of said rotatable medium which was in contact with said cleaning blade before the start of the image forming operation.

14. An apparatus according to claim 11, wherein said latent image forming means includes reciprocable means for the application of scanning image light to said rotatable medium, said apparatus further comprising means for detecting that said reciprocable means is at a predetermined position and wherein said counting means starts its counting operation in response to an output of said detecting means.

15. An apparatus according to claim 14, wherein said predetermined position is a rest position for said reciprocable means, and wherein said control signal generating means includes means for generating a signal for initiating forward movement of said reciprocable means in accordance with an output of said detecting means and the pulse signals.

16. An apparatus according to claim 14, wherein said predetermined position is the position to which said reciprocable means is returned after a scanning operation, and wherein said control signal generating means includes means for generating a signal for stopping movement of said reciprocable means in accordance with an output of said detecting means and the pulse signals.

17. An apparatus according to claim 16, further comprising a cleaning blade for cleaning the surface of said rotatable medium for repetitive use, wherein said developing means develops the latent image with a liquid developer, and wherein said control means rotates said rotatable medium to clean the entire surface of said rotatable medium with said cleaning means after an image has been transferred to transfer material and thereafter stops said rotatable medium.

18. An apparatus according to claim 17, further comprising means for generating, in response to an image formation instruction signal during the rotation of said rotatable medium after transfer of the image, a signal for starting a further image forming operation without completing the additional rotation thereof.

19. An apparatus according to claim 14, wherein said predetermined position is the position to which said reciprocable means is returned after a scanning operation, and wherein said control signal generating means includes means for generating a signal for discriminating whether or not the transfer material is jammed along its travel path in accordance with an output of said detecting means and the pulse signals.

20. An apparatus according to claim 11, further comprising means for interrupting the image forming operation and applying light to the rotatable medium to correct its sensitivity, and means for generating a signal for terminating said application of light after a particular number of pulse signals.

21. An apparatus according to claim 11, further comprising means for cleaning the surface of said rotatable medium for repetitive use, wherein said control signal generating means includes means for generating a signal to stop the rotation of said rotatable medium once a certain number of pulse signals is counted by said counting means, said rotatable medium being rotated in response to actuation of a main switch.

22. An apparatus according to claim 11, wherein said rotatable medium has an endless photosensitive member.

23. Image forming apparatus comprising:

a rotatable medium;

means for forming an electrostatic latent image on a surface of said rotatable medium, said electrostatic latent image forming means including reciprocable means for the application for scanning image light from an original onto said rotatable medium;

means for developing the latent image into a toner image;

means for transferring the toner image from said rotatable medium to a transfer material;

means for cleaning the surface of said rotatable medium for repetitive use of said rotatable medium;

means for rotating said rotatable medium in synchronism with operation of said latent image forming means, developing means, transfer means and cleaning means;

means for detecting that said reciprocal means is at a predetermined position along its reciprocating path of movement; and means for generating a signal for stopping the rotation of said rotatable medium after a predetermined time from the detection of said detecting means.

24. An apparatus according to claim 23, wherein said signal for stopping the rotation of said rotatable medium is generated when a predetermined number of pulse signals is counted after an output of said detecting means is produced, wherein said predetermined position is the position to which said reciprocable means is returned after a scanning operation, the predetermined number corresponding to the time period required for cleaning the entire surface of said rotatable medium after the image has been transferred to a transfer material.

25. An apparatus according to claim 24, further comprising means for generating, in response to an image formation instruction signal during the rotation of said rotatable medium after transfer of the image, a signal for starting a further image formation operation without completing the additional rotation thereof.

26. An apparatus according to claim 23, further comprising means for generating a signal for discriminating whether or not the transfer material is jammed along its travel path after a predetermined number of pulse signals has been counted by counting means.

27. Image forming apparatus comprising:

a rotatable medium;

means for forming an electrostatic latent image on a surface of said rotatable medium, said electrostatic latent image forming means having reciprocable means for the application of scanning image light from an original onto said rotatable medium;

means for developing the latent image into a visible image;

means for transferring the visible image from said rotatable medium to a transfer material.;

means for generating a series of pulse signals in accordance with the rotation of said rotatable medium;

means for detecting that said reciprocable means is at a predetermined position along its reciprocating path;

means for counting the pulse signals from said signal generating means; and control signal generating means for starting the counting operation of said counting means in response to an output from said detecting means and for generating a signal for controlling the image forming operation with said rotatable medium, electrostatic latent image forming means, developing means and transfer means in response to the counting of a predetermined number of pulse signals by said counting means.

28. An apparatus according to claim 27, wherein said control signal generating means includes means for generating a signal for stopping the rotation of said rotatable medium.

29. An apparatus according to claim 28, wherein said signal for stopping the rotation of said rotatable medium is generated when a certain number of pulse signals is counted after an output of said detecting means is produced, said predetermined position being the position to which said reciprocable means is returned after a scanning operation, the certain number corresponding to the time period required for cleaning the entire surface of said rotatable medium after the image has been transferred to a transfer material.

30. An apparatus according to claim 29, further comprising means for generating, in response to image formation instruction signal during the rotation of said rotatable medium after transfer of the image, a signal for starting further image formation operation without completing the additional rotation thereof.

31. An apparatus according to claim 27, wherein said predetermined position is a rest position for said reciprocable means, and said control signal generating means includes means for generating a signal for starting forward movement of said reciprocable means in accordance with an output from said detecting means and the pulse signals.

32. An apparatus according to claim 27, further comprising means for generating a signal for discriminating whether or not the transfer material is jammed along its travel path in response to the counting of a further number of pulse signals by said counting means.

33. An apparatus according to claim 27, wherein said counting means starts counting in response to the actuation of a main switch of said apparatus or an image formation instruction signal, said apparatus further comprising means for generating a signal for actuating said reciprocable means upon the counting of a particular number of pulse signals by said counting means.

34. An apparatus according to claim 33, further comprising means for cleaning the surface of said rotatable medium for repetitive use thereof, wherein said control signal generating means includes means for generating a signal for stopping the rotation of said rotatable medium when a certain number of pulse signals is counted by said counting means, said rotatable medium being rotated in response to actuation of a main switch.

35. An apparatus according to claim 34, wherein said predetermined number of pulse signals is greater than the number of pulse signals generated during one full rotation of said rotatable medium.

36. An apparatus according to claim 33, further comprising a cleaning blade for cleaning the surface of said rotatable medium for repetitive use of said rotatable medium wherein said control means also generates a signal for starting the movement of said reciprocable means only after said rotatable medium is rotated by an amount such that the initial image forming operation is not performed on a portion of said rotatable medium which was in contact with said cleaning blade before the start of the image forming operation.

37. An apparatus according to claim 27, wherein said rotatable medium has an endless photosensitive member.

38. Image forming apparatus comprising:

a rotatable medium;

means for forming an electrostatic latent image on a surface of said rotatable medium, said means including reciprocable means for the application of a scanning image light from an original onto said rotatable medium;

means for developing the latent image into a visible image;

means for transferring the visible image from said rotatable medium to a transfer material;

first detecting means for detecting that said reciprocable means is at a predetermined position along its reciprocable path;

means for generating a first signal in response to an output from said first detecting means and for generating a second signal after a predetermined period of time after the generation of the first signal;

second detecting means for detecting when the leading edge of the transfer material reaches a particular position;

set-reset means which is set in response to the first signal and reset in response to an output of said second detecting means; and means for generating a jam signal when said set-reset means is set at the time that the second signal is generated.

39. An apparatus according to claim 38, wherein said predetermined position is the position to which said reciprocable means is returned after a scanning operation, and wherein said second signal is generated after a predetermined number of pulse signals, generated in accordance with the rotation of said rotatable medium, have been generated after the generation of said first signal.

40. An apparatus according to claim 38, wherein said rotatable medium has an endless photosensitive member.

* * * * *

UNITED STATES PATENT OFFICE

CERTIFICATE OF CORRECTION

Patent No. 4,139,300 Dated February 13, 1979

Inventor(s) HAJIME KATAYAMA, ET AL.

It is certified that error appears in the above-identified patent and that said Letters Patent are hereby corrected as shown below:

Column 1, line 34, "latent" should read --latent image--;

Column 2, line 27, "moment" should read --moment by moment--;

Column 4, line 19, "the" (first occurrence) should read --in--;

Column 6, line 6, "24 device" should read --device 24--;

Column 6, line 55, "30" should read --39--;

Column 6, line 60, "react" should read --reach--;

Column 7, line 42, "carrier" should read --carriage--;

Column 7, line 56, "carrier" should read --carriage--;

Column 10, line 55, "pulse" should read --pulses--;

Column 13, line 5, "wherebby" should read --whereby--;

Column 15, line 31, change "15-10a" to --15a--;

Column 15, line 56, "terinal" should read --terminal--;

Column 16, line 30, "211" should read --221--;

Column 17, line 8, "This," should read --Thus,--;

UNITED STATES PATENT OFFICE

CERTIFICATE OF CORRECTION

Patent No. 4,139,300 Dated February 13, 1979

Inventor(s) HAJIME KATAYAMA, ET AL.

It is certified that error appears in the above-identified patent and that said Letters Patent are hereby corrected as shown below:

Column 17, line 67, "termonals" should read --terminals--;

Column 18, line 62, "drum to an end" should read --drum comes to an end--;

Column 20, line 3, "originl" should read --original--;

Column 21, line 45, "In present" should read --In the present--;

Column 25, line 44, "described above." at the end of the line, should be deleted.

Signed and Sealed this

Twenty-third Day of September 1980

[SEAL]

Attest:

SIDNEY A. DIAMOND

Attesting Officer

Commissioner of Patents and Trademarks